US010653914B2

(12) United States Patent
Ellis et al.

(10) Patent No.: US 10,653,914 B2
(45) Date of Patent: May 19, 2020

(54) UPPER AND LOWER BODY PUSH AND PULL EXERCISE MACHINE WITH A ONE DIRECTIONAL RESISTANCE MECHANISM AND ADJUSTABLE ANGLE

(71) Applicant: Product Design Innovations, LLC, Ocala, FL (US)

(72) Inventors: Joseph K. Ellis, Ocala, FL (US); Joshua M. Aguilar, Gainesville, FL (US)

(73) Assignee: Product Design Innovations, LLC, Ocala, FL (US)

( * ) Notice: Subject to any disclaimer, the term of this patent is extended or adjusted under 35 U.S.C. 154(b) by 85 days.

(21) Appl. No.: 15/848,656

(22) Filed: Dec. 20, 2017

(65) Prior Publication Data

US 2018/0111019 A1 Apr. 26, 2018

Related U.S. Application Data

(63) Continuation-in-part of application No. 14/840,776, filed on Aug. 31, 2015, now Pat. No. 9,873,016.

(51) Int. Cl.
*A63B 22/06* (2006.01)
*A63B 23/035* (2006.01)
(Continued)

(52) U.S. Cl.
CPC ..... *A63B 22/0664* (2013.01); *A63B 21/068* (2013.01); *A63B 21/154* (2013.01);
(Continued)

(58) Field of Classification Search
CPC ..... A63B 22/00–208; A63B 22/0664; A63B 23/02–0238; A63B 21/068; A63B 22/0023; A63B 21/154; A63B 22/001; A63B 21/22; A63B 23/03575; A63B 2022/067; A63B 2208/0214; A63B 2208/0228; A63B 2225/093; A63B 2022/0676; A63B 2022/0043; A63B 2022/0041; A63B 2022/002; A63B 21/225; A63B 21/012; A63B 21/0088; A63B 21/005; A63B 69/0048; A63B 21/4045; A63B 22/0017
See application file for complete search history.

(56) References Cited

U.S. PATENT DOCUMENTS 4,848,737 A 7/1989 Ehrenfield
5,370,594 A 12/1994 Grinblat
(Continued)

*Primary Examiner* — Nyca T Nguyen
(74) *Attorney, Agent, or Firm* — Laurence P. Colton; Smith Tempel Blaha LLC

(57) ABSTRACT

A machine for concurrently performing opposing pushing and pulling motions with the legs and arms at various angles to simulate multiple exercises including climbing, running and crawling motions, wherein the machine is adjustable in angle. The individual lower body user supports move in a back and forth pattern on rails and include foot platforms and shin support pads for support a user's lower body and pivoting upper body user support hand grips wherein the left upper body user support and left lower body user support move in opposite directions and the right upper body user support and right lower body user support move in opposite directions and all four user supports move in unison.

41 Claims, 14 Drawing Sheets

(51) Int. Cl.

| | |
|---|---|
| ***A63B 21/22*** | (2006.01) |
| ***A63B 22/00*** | (2006.01) |
| ***A63B 21/00*** | (2006.01) |
| ***A63B 21/068*** | (2006.01) |
| ***A63B 22/20*** | (2006.01) |
| ***A63B 21/008*** | (2006.01) |
| *A63B 21/012* | (2006.01) |
| *A63B 21/005* | (2006.01) |
| *A63B 69/00* | (2006.01) |

(52) U.S. Cl.

CPC ..... *A63B 21/22* (2013.01); *A63B 21/4045* (2015.10); *A63B 22/001* (2013.01); *A63B 22/0017* (2015.10); *A63B 22/0023* (2013.01); *A63B 22/208* (2013.01); *A63B 23/03575* (2013.01); *A63B 21/005* (2013.01); *A63B 21/0088* (2013.01); *A63B 21/012* (2013.01); *A63B 21/225* (2013.01); *A63B 69/0048* (2013.01); *A63B 2022/002* (2013.01); *A63B 2022/0041* (2013.01); *A63B 2022/0043* (2013.01); *A63B 2022/067* (2013.01); *A63B 2022/0676* (2013.01); *A63B 2208/0214* (2013.01); *A63B 2208/0228* (2013.01); *A63B 2225/093* (2013.01)

(56) References Cited

U.S. PATENT DOCUMENTS

| | | | | |
|---|---|---|---|---|
| 5,518,483 | A | 5/1996 | Oswald | |
| 5,554,086 | A | 9/1996 | Habing | |
| 5,569,132 | A | 10/1996 | Wu | |
| 5,580,340 | A | 12/1996 | Yu | |
| 6,264,588 | B1 | 7/2001 | Ellis | |
| 6,287,241 | B1 | 9/2001 | Ellis | |
| 6,361,476 | B1 | 3/2002 | Eschenbach | |
| 7,104,933 | B1 | 9/2006 | Liao | |
| 7,220,221 | B2 | 5/2007 | Moismann | |
| 7,232,404 | B2 | 6/2007 | Nelson | |
| 7,244,217 | B2 * | 7/2007 | Rodgers, Jr. | A63B 22/001 482/52 |
| 7,335,140 | B2 | 2/2008 | Webber | |
| 7,455,633 | B2 | 11/2008 | Brown | |
| 7,585,263 | B2 | 9/2009 | Brown | |
| 7,594,880 | B2 | 9/2009 | Webber | |
| 7,611,446 | B2 | 11/2009 | Chuang | |
| 7,662,076 | B1 | 2/2010 | Ho | |
| 7,727,128 | B2 | 6/2010 | Giannelli | |
| 7,731,638 | B2 | 6/2010 | Webber | |
| 7,780,585 | B1 * | 8/2010 | Rivas | A63B 21/0552 482/140 |
| 7,833,143 | B1 | 11/2010 | Tsai | |
| 7,867,149 | B1 | 1/2011 | Webber | |
| 7,963,890 | B2 | 6/2011 | Webber | |
| 8,025,609 | B2 | 9/2011 | Giannelli | |
| 8,162,807 | B1 | 4/2012 | Webber | |
| 8,172,732 | B1 | 5/2012 | Webber | |
| 8,317,665 | B2 | 11/2012 | Webber | |
| 8,888,661 | B2 | 11/2014 | Ellis | |
| 9,649,529 | B1 * | 5/2017 | Miller | A63B 22/0664 |
| 2002/0013199 | A1 | 1/2002 | Giannelli | |
| 2002/0019298 | A1 * | 2/2002 | Eschenbach | A63B 22/001 482/51 |
| 2005/0148438 | A1 * | 7/2005 | Carlsen | A63B 22/001 482/52 |
| 2009/0247370 | A1 | 10/2009 | Stearns | |
| 2010/0048367 | A1 | 2/2010 | Kiang | |
| 2010/0311555 | A1 | 12/2010 | Campanaro | |
| 2011/0028283 | A1 | 2/2011 | Webber | |
| 2013/0331238 | A1 * | 12/2013 | Ellis | A63B 21/159 482/97 |
| 2015/0182787 | A1 * | 7/2015 | Liu | A63B 22/001 482/52 |
| 2015/0283425 | A1 * | 10/2015 | Zhou | A63B 22/001 482/56 |
| 2015/0343250 | A1 * | 12/2015 | Lagree | A63B 23/0233 482/142 |
| 2016/0213970 | A1 * | 7/2016 | Eschenbach | A63B 22/001 |
| 2017/0157460 | A1 * | 6/2017 | Lin | A63B 22/0015 |
| 2017/0296865 | A1 * | 10/2017 | Lagree | A63B 21/0622 |

* cited by examiner

UPPER AND LOWER BODY PUSH AND PULL EXERCISE MACHINE WITH A ONE DIRECTIONAL RESISTANCE MECHANISM AND ADJUSTABLE ANGLE

STATEMENT OF RELATED APPLICATIONS

This patent application claims priority on and the benefit of U.S. patent application Ser. No. 14/840,776 having a filing date of 31 Aug. 2015.

BACKGROUND OF THE INVENTION

Technical Field

This invention relates to the general technical field of physical fitness and exercise equipment and machines. This invention relates more specifically to the field of exercise equipment for concurrently exercising the user's upper and lower body by performing reciprocating left side and right side pushing and pulling motions resisted by a one directional resistance mechanism.

Prior Art

Exercise, physical fitness and physical therapy equipment and machines are available in various configurations and for various purposes, and are available for all of the major muscle groups. In the general exercise equipment field, there are generally two categories of machines. One category of machines known as strength or anaerobic training machines are geared more towards lower repetition, shorter duration and higher resistance exercises and there are many configurations of strength training machines that exercise a specific muscle group or set of muscle groups. A second category commonly known as cardiovascular or aerobic training machines are generally geared towards longer duration, lower resistance and higher repetition exercise.

There are many configurations of cardiovascular training machines that exercise a specific muscle group or set of muscle groups such as treadmills, stationary bikes, stair climbing machines, ladder climbing machines, elliptical striding machines, arcing strider machines and other specialized machines. Many of these machines incorporate a rotational reciprocating crank component into the motion that defines and controls the range of motion. This reciprocating close loop crank requires the user regardless of size or capabilities to follow that full range of motion to operate the machine. This fixed range of circular crank motion also allows the machine to create momentum during operation of the machine and does not require adequate sustained effort from the user to keep the machine moving. Moreover, these machines that incorporate a rotational reciprocating motion into the mechanical features of the machine require the user to follow the complete closed loop range of motion predetermined by the machine because at least a portion of the linkage travels in an endless circular path. Therefore, many of these rotational linkage reciprocating motion machines require additional components to make the range of motion of the arc or ellipse adjustable to fit users of various sizes and with various capabilities. Also, most of these machines position the user in a mostly vertical orientation allowing the user to simply shift their weight from side to side to operate the machine as opposed to being able to get into an angular more powerful forward leaning position to drive the foot pedals and handles forward while operating the machine.

An improved exercise machine would incorporate the benefits of both cardiovascular and strength training machines into a single exercise motion that concurrently engage a user's upper and lower body muscle groups with resisted pushing and pulling motions while allowing the user to define the range of motion of the foot pedals and handles and engage pushing and pulling force into the resistance mechanism without creating reciprocal momentum and simulate multiple exercises including climbing, hiking, running and crawling.

Other machines have been developed that concurrently engage a user's upper and lower body into one exercise motion but all of these machines have various deficiencies as described in the previous paragraph when compared to the present invention disclosed herein.

U.S. Pat. No. 6,361,476 of Eschenbach illustrates an elliptical exercise striding machine with individual left and right foot pedals, each movably mounted to and dependently connected by an adjustable rotational crank arm assembly proximal to a first end and supported by either a rolling wheel or pivoting handle linkage proximal to a second end. During operation of the machine, the foot pedals move dependently in a rotating ellipse with a closed loop range of motion and can be adjusted in stride length and the shape or motion pattern of the elliptical motion can be adjusted. The left-side foot pedals and handles and right-side foot pedals and handles are dependently connected in opposing positions of the range of motion and move in unison. This closed loop range of motion of the elliptical pattern requires the user to follow the machines complete range of motion requiring the range of motion to be adjustable to fit various size users with various capabilities adding additional components and wear components to the cost of the machine. This closed loop motion also creates momentum that decreases the force required by the user to keep the machine moving. It also prevents short burst of high force motions without increasing the speed of the motion of the foot pedals and handles. This causes the machine to create an exercise that is mostly aerobic versus a machine that can create both aerobic and anaerobic exercises.

U.S. Pat. No. 8,025,609 of Giannelli et al. illustrates a striding exercise machine comprising a pair of pivotally supported individual foot pedals that are dependently linked together through a rotational crank assembly and move in unison in a back and forth fixed range of motion arcuate path with the arcuate path being adjustable to a selected segment. The apparatus includes handles or arms interconnected or interlinked to the foot pedals for upper body pushing or pulling energy input. The handles or arms pivot together with and in the same back and forth direction as the pedals to which they are inter-linked and the left-side pedals and arms are in an opposing position of the range of motion as the right said pedals and arms. The motions of the pedals and handles or arms are controlled by a circular rotating crank linkage assembly. This closed loop range of motion of the elliptical pattern requires the user to follow the machine linkage's complete circular range of motion requiring the range of motion to be adjustable to fit users of various sizes and capabilities. Adding this adjustment feature to the machine is costlier to produce and creates additional wear components. This closed loop motion of the pedals and handles also prevents short burst of high force motions without increasing the speed of the motion of the foot pedals and handles. This causes the machine to create an exercise that is mostly aerobic versus a machine that can create both aerobic and anaerobic exercises.

US Patent Publication No. 2009/0247370 of Stearns et al. illustrates an elliptical striding machine comprising opposing left and right crank assemblies mounted to the base frame about a common axis. Left- and right-side foot support linkages are supported proximal to a first end by a movable rocker shaft that is mounted on opposing ends to the left- and right-side crank assemblies. Said left and right foot support linkages are operatively linked to and supported by left- and right-side handle bars that are pivotally mounted to an upper portion of the stationary frame. The rotating rocker support shaft and linkage assembly are configured such that the left foot support and left handle bar assembly are 180 degrees out of phase with the right foot support and right handle bar assembly such that the left- and right-side user engagement features are opposing in the range of motion of the machine and remain as such during operation of the machine. Left- and right-side draw bars are pivotally mounted at a first end to an upper portion of the stationary main frame and movably mounted at a second end to the left- and right-side crank assemblies such that the draw bars can be adjusted to alter the range of motion and shape of the elliptical motion of the foot pedal assemblies during operation of the machine. The motions of the left- and right-side foot support and handle bar assemblies are controlled by the closed loop circular rotating motion of the left- and right-side cranks and rocker shaft assembly such that the left- and right-side foot support assemblies are geometrically opposed along the shape of the elliptical motion path and remain that way during operation of the machine. This closed loop range of motion of the elliptical pattern requires the user to follow the machines complete range of motion requiring the range of motion to be adjustable to fit various size users with various capabilities and these additional components of the adjustment feature increase the cost of the machine and create additional wear components. This closed loop motion of the pedals and handles also prevents short burst of high force motions without increasing the speed of the motion of the foot pedals and handles. This causes the machine to create an exercise that is mostly aerobic versus a machine that can create both aerobic and anaerobic exercises.

U.S. Pat. No. 4,848,737 of Ehrenfield illustrates a ladder climbing exercise machine comprising a stationary base frame and a pivotally supported movable ladder assembly wherein the movable ladder assembly is pivotally connected at a location proximal to a central portion of the ladder assembly to elongated support members extending upwards from the base frame such that the ladder assembly can be adjusted to various angles of vertical orientation. The ladder assembly being operatively connected to a moving retarder means for controlling the speed of movement of the ladder assembly during operation of the machine. The movement of the ladder is driven by the user's body weight as the user climbs the ladder and puts their body weight on the ladder rungs. This machine does cause the user to simultaneously lift their legs and arms in an alternating pattern as they perform a climbing motion and the entire user support can be adjusted to various angles but that angle adjustment is limited to absolute vertical and slightly off of vertical on either side of a perpendicular orientation to the base frame because the user's body weight is required to propel the motion of the ladder assembly. Moreover, the user is working against gravity by lifting their own body weight and not engaging a resistance to their movement produced by the machine. Also, the user does not constantly stay engaged with the user support components as they operate the machine. While this can be a useful exercise machine, the overall diversity is limited compared to the current invention disclosed herein.

Most users do not know how to best move their bodies on an exercise machine to get the safest and most efficient workout. However, as users come in various shapes and sizes, a machine that defines the motion path but allows the user to control the range of motion will provide the safest, most efficient and comfortable workout. Also, a machine that will allow a user to put as much pushing and pulling force into the exercise motion as they prefer but also control the speed of motion of the user engagement features will allow the user to concentrate on aerobic or anaerobic exercise conditioning or a combination of the two.

BRIEF SUMMARY OF THE INVENTION

The present invention creates multiple pushing and pulling exercises that engage various muscle groups by varying the angle of the machine from mostly vertical to mostly horizontal. The frame of the machine is elongated having a forward end and rearward end. Mounted on the frame is a left side foot platform and shin support pad and a left side handle that are linked such that the user's left leg and left arm can push in unison or pull in unison. Also mounted on the frame is a right side foot platform and shin support pad and a right side handle that are linked such that the user's right leg and right arm can push in unison or pull in unison. The left and right side pushing and pulling assemblies are linked such that a pushing motion of one leg and arm will move concurrently with a pulling motion of the other leg and arm. The user's hands and feet move in concurrent fixed arcing paths of reciprocating pushing and pulling motions that are defined by the machine but the range of the motion is controlled by the user. Each left and right side pushing and pulling assembly cooperates with individual one directional clutches that engage and rotate a common axle that is operatively connected to a one directional rotational resistance mechanism. The rearward portion of the machine pivots relative to the floor and the forward portion of the machine is supported by an angle adjusting device wherein the angle of the pushing and pulling motions relative to the floor is adjustable such that the user can perform a variety of exercise motions similar to climbing, hiking, running, crawling, and other exercise motions.

In each preferred embodiment of the invention the frame is capable of adjusting less than 90 degrees and is adjustable with an angle adjusting device between angles that are below one side of a vertical line and above a horizontal line such that the user is always oriented in a forward leaning position. Individual left and right foot platforms and shin support pads support and brace the user's lower legs as he or she leans into the exercise motion in a position that generates maximum leverage and power. The foot support platforms and shin pads are supported by and move along a curved rail to mimic the natural leg motion of a pushing or pulling exercise. The individual left and right grip handles for the arm pushing and pulling motions move in pivoting arcing motions to mimic the natural arm motion of a pushing or pulling exercise. The arm and leg motions are operatively connected with a multi-link linkage system that reciprocates in a back and forth motion but does not rotate around a circular crank, which allows the user to control the range of the reciprocating motion. The pushing and pulling arms are each adjustable in length from the pivot mount to the gripping handle and adjusted preferably with actuators that are synced with the angle adjusting device such that the angle of the frame and the length of the left and right pushing and pulling arms are optimized for the biomechanical effectiveness of each exercise and the comfort of the user.

In preferred embodiments of the invention, the rotational inertia resistance mechanism can consist of a flywheel with electromagnetic resistance, a flywheel with an adjustable friction resistance, a fan blade air resistance, an alternator assembly, a liquid and rotational blade resistance, or combination of these mechanisms or other similar mechanisms.

In one embodiment, the invention is comprised of a stationary base frame and a movable user support frame pivotally attached to the base frame at the rearward end and supported at the forward and central portion with the angle adjusting device such that the movable user support can be adjusted in angle relative to the stationary base frame and the floor.

In another embodiment, the invention is comprised of a movable frame with a rearward floor contact support and the forward and central portion of the movable frame is supported by rollable pivoting support arm and angle adjusting device such that the support arm is in rollable contact with the floor as the angle of the movable frame is adjusted relative to the floor.

In either embodiment of the invention, the left and right curved rails that support the left and right foot platforms and shin support pads can be mounted on the machine in a parallel configuration or an angled configuration. In the angled configuration, the rails are more proximal to one another in the forward portion of the machine closer to the angle adjusting device and the left and right curved rails are more distal to one another in the rearward portion of the machine away from the angle adjusting device.

In either embodiment of the invention, the left and right side pushing and pulling arms can be pivotably mounted on the machine in a parallel configuration or an angled configuration. In the angled configuration the handles move towards a vertical center line of the users body in the push direction and away from a vertical center line of the users body in a pull direction.

Concurrent upper and lower body exercises are very beneficial forms of exercising to increase strength and flexibility of the major muscle groups as well conditioning of the cardio-pulmonary system. Most everyday human physical activities involve movement of multiple joints concurrently with engagement of multiple muscle groups moving in multiple dimensional planes of motion. Therefore, exercise machines offering multi-dimensional planes of motion will better condition the body to perform the way it naturally moves. Moreover, exercise machines that allow a user to concurrently perform pushing and pulling motions with all four limbs by reciprocating the left side limbs and the right side limbs will best strengthen a user's core torso musculature and soft tissue, which is critically important to performing a variety of physical activities.

BRIEF DESCRIPTION OF THE DRAWINGS

In some figures, the invention is illustrated from one side and in these figures the invention looks the same, but in a general mirror image, from the opposite side, with both sides having similar structures, features, and components.

DETAILED DESCRIPTION OF PREFERRED EMBODIMENTS

Figure 1:
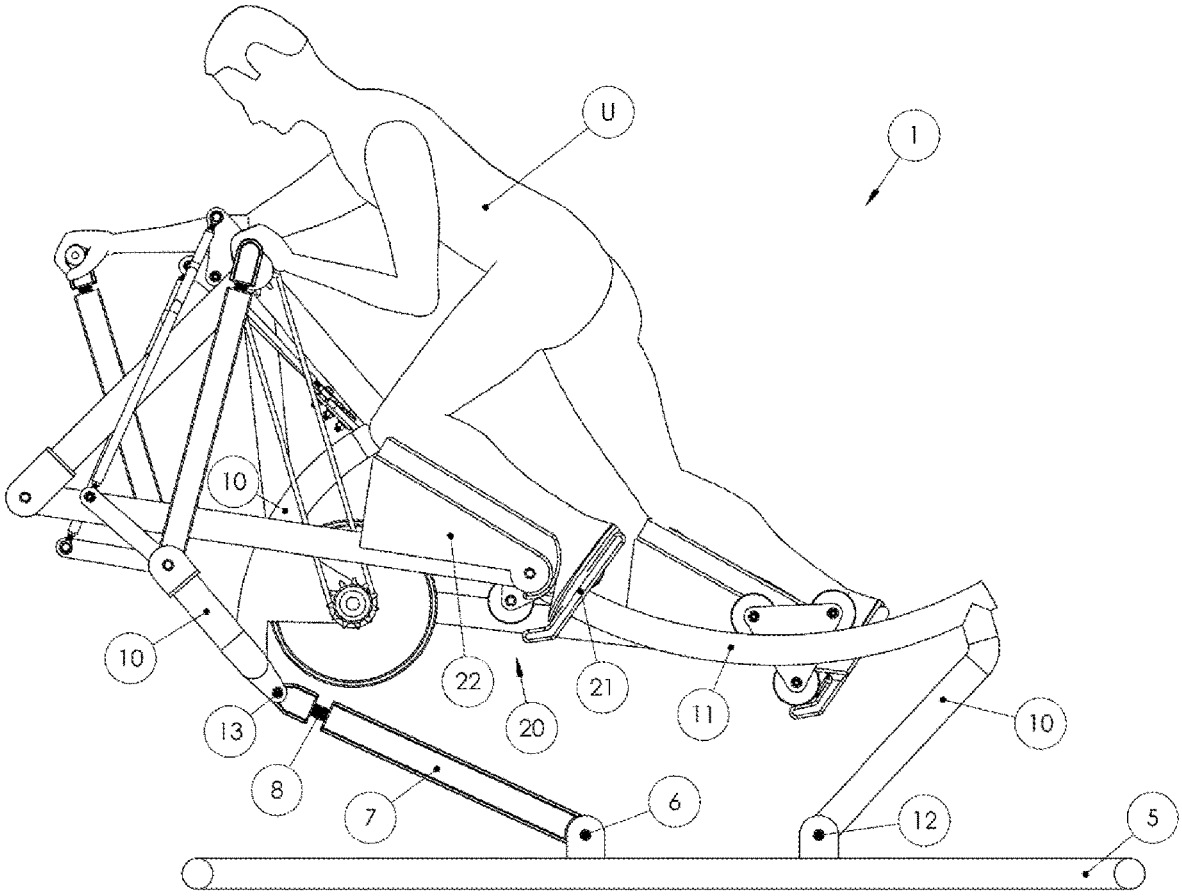
FIG. 1 is a side view of a first embodiment of the invention at a lower angle position with a user performing a simulated crawling motion exercise.

Exemplary preferred embodiments are disclosed below in connection with the attached drawings. Throughout this specification, various terms will be used to describe various elements or sets of elements, features or sets of features, and devices or sets of devices. For example, the term movable frame will refer to the frame can change in angle and that supports the operational components of the machine. The term rearward end or portion of the machine will refer to the end or portion of the machine most near the user's feet and distal to the user's hands. The term forward end or portion of the machine will refer to the end or portion of the machine most near the user's hands and distal to the user's feet. The term linkage or linkage assembly will refer to the movable components that connect the user engage features and cooperate with the drive components and resistance components. The terms push, pushing, press, pressing, pull or pulling when referring to the user operating the machine will be used to describe any motion or movement by a user when they are maintaining or increasing their exertion force. The term upper body will refer generally to the user's arms and hands but may also refer to the user's chest, back, and torso as well. The term lower body will generally refer to the user's legs and feet but may also refer to the user's buttocks and hips as well. The term lower legs will refer to the user's shin, ankles and feet and in some instances the user's knees. The terms limbs or extremities will refer to the user's arms and legs. The term actuator or angle adjusting device will refer to any mechanism that extends or contracts so as to increase or decrease the length or angle of an operable component or set of components. The term pivot will refer to an axle or fastener in which a component or set of components rotate upon. The invention is comprised of many identical left and right components as illustrated in various perspective views and many of these components will frequently be referred to and described in a plural context so as to prevent the duplication of descriptions of identical left and right components.

FIGS. 1-14 are all views of embodiments of the invention this inventor refers to as "an upper and lower body push and pull exercise machine with a one directional resistance mechanism and adjustable angle". Generally, the invention is a machine for concurrently pushing with one side of the user's body while concurrently pulling with other side of the user's body in a reciprocating back and forth motion while being resisted by a one directional resistance mechanism. The user supports are operatively connected by a multi-link linkage assembly and operate in unison such that movement of any of the user engagement components will concurrently move all of the user engagement components. All of the operational components of the machine are mounted on a movable frame that in a first embodiment is pivotally mounted on a stationary base frame and in a second embodiment the movable frame directly engages the floor and does not require a separate base frame. In each embodiment, the movable frame is adjustable in angle during operation of the machine such that the user can perform multiple pushing and pulling exercises at various angles relative to the stationary base frame and relative to the floor.

Referring now to FIGS. 1-14, various views of all embodiments of the machine 1 are shown to provide a more complete understanding of the invention. FIGS. 1-14 all illustrate a set of left and right curved lower body support rails 11 mounted on a rearward portion of movable frame 10. Traveling member assemblies 80 are rollably engaged with curved lower body support rails 11. Lower body user support assemblies 20 are pivotally connected to traveling member assemblies 80 with lower body user support pivots 29. Lower body user support assemblies 20 are connected to a linkages connection hubs 70 with first lower body support linkage bars 24 and second lower body support linkage bars 26. Upper body user support assemblies 30 are pivotally connected to movable frame 10 at upper body user support pivots 34 and upper body user support assemblies 30 are connected to linkages connection hubs 70 with upper body user support linkage connection flanges 35, upper body user support linkage bars 37 and linkages connection hub flanges 71. Resistance axle 41 is connected to movable frame 10 with resistance axle connection flanges 42 and linkages. Connection hubs 70 are connected to resistance mechanism 40 with resistance drive assembly 50. Rocker arm linkage assembly 60 operatively connects left lower body user support assembly 20 and left upper body user support assembly 30 to right lower body user support 60 and right upper body user support 30 such that the left and right upper and lower body user supports move in unison during operation of machine 1.

FIGS. 1-9 illustrate a first embodiment of the invention wherein movable frame 10 is pivotally mounted proximal to a rearward end proximal to a rearward end of stationary base frame 5 with movable frame base pivot 12. Movable frame 10 is pivotally connected proximal to a forward end at angle adjusting device upper pivot 13 such that angle adjusting device 7 supports the forward portion of movable frame 10 and angle adjusting device 7 adjusts the angle of movable frame 10 by extending and contracting angle adjusting shaft 8 causing movable frame 10 to pivot about movable frame base pivot 12 such that the angle of movable frame 10 increases or decreases relative to stationary base frame 5 and the floor.

FIGS. 10-13 illustrate a second embodiment of the invention wherein the rearward portion of movable frame 10 is in direct contact with the floor and pivots on movable frame foot 9. A central portion of movable frame 9 is connected to and pivots on angle adjusting support arm pivot 19 and a forward portion of movable frame 10 is connected to and pivots on angle adjusting device upper pivot 13. Angle adjusting device 7 is pivotally connected to angle adjusting support arm 16 at angle adjusting device lower pivot 6. Angle adjusting support arm cross brace 17 is connected in a perpendicular configuration at a central location to a forward end of angle adjusting support arm 16. An angle adjusting support arm wheel 18 is connected to each end of angle adjusting support arm cross brace 17. Angle adjusting support arm wheels 18 are in rollable contact with the floor. Angle adjusting support arm wheels 18 roll forward when the angle of movable frame 10 is decreasing relative to the floor as movable frame 10 pivots about movable frame foot 9. Angle adjusting support arm wheels 18 roll rearward when the angle of movable frame 10 is increasing relative to the floor as movable frame 10 pivots about movable frame foot 9.

Figure 13:
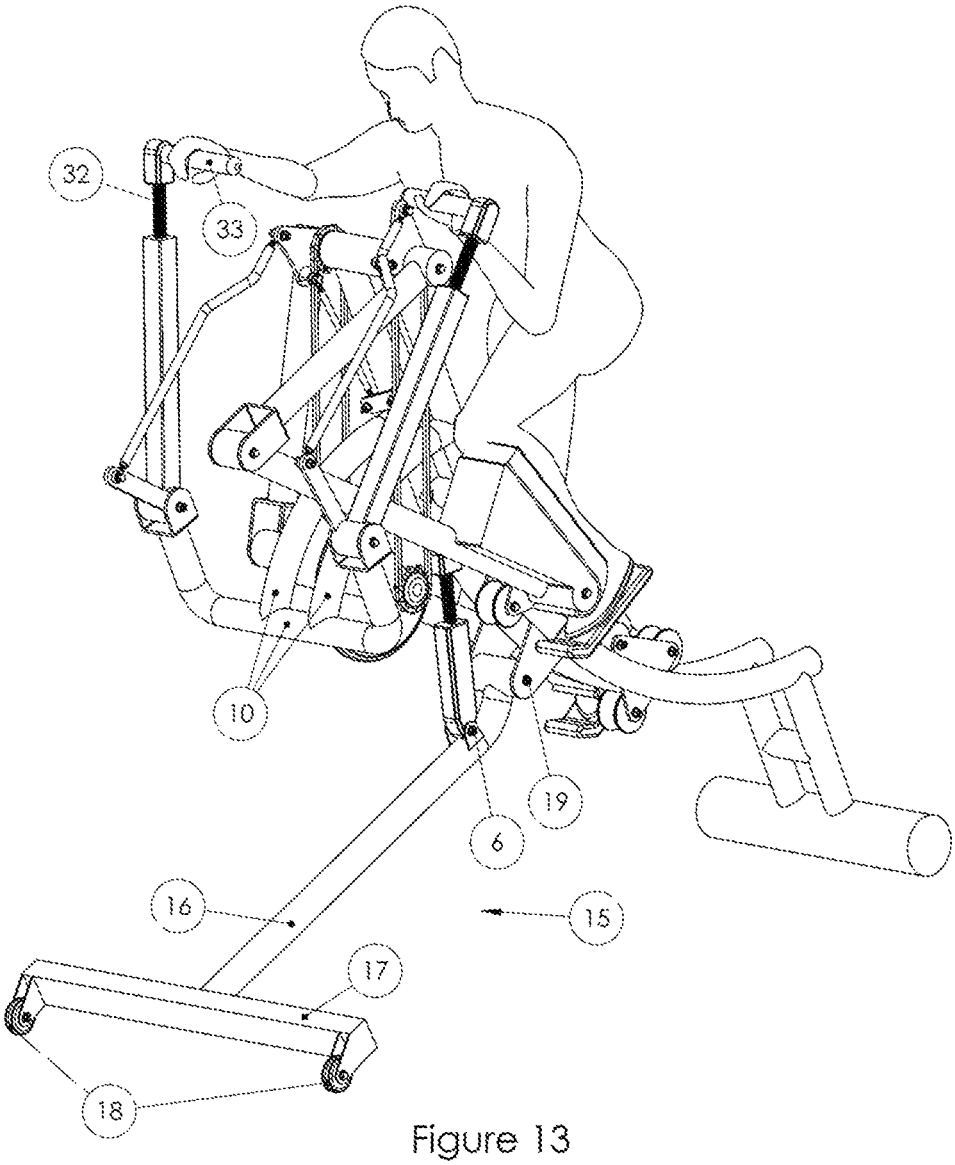
FIG. 13 is a front perspective view of a second embodiment of the invention a mid-point angle position with a user performing a simulated hill climbing exercise.
Figure 14:
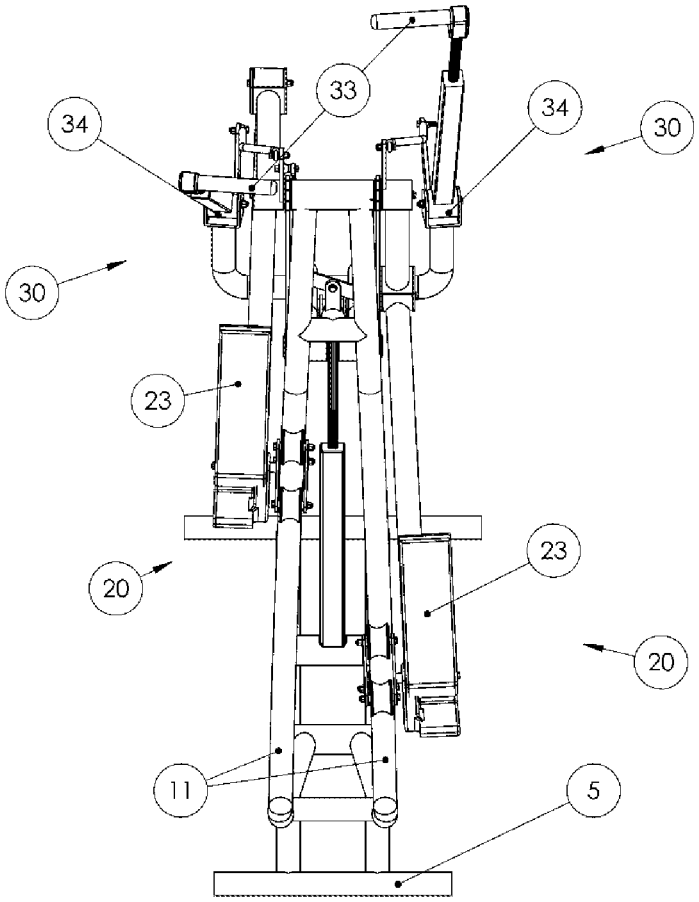
FIG. 14 is a rear view of a third embodiment of the invention at a higher angle position with converging lower body supports and converging and diverging push and pull arms.

FIG. 14 illustrates alternative configurations to the pushing and pulling motions of machine 1. FIGS. 1-13 illustrate the invention wherein the pushing and pulling arms move in a parallel motion to one another and the lower body supports move back and forth in a parallel motion to one another. In FIG. 14 the forward ends of lower body support rails 11 are mounted on movable frame 10 in a narrower more proximal distance to one another and the rearward ends of lower body support rails 11 are mounted on movable frame 10 in a wider more distal distance to one another such that the distance between lower body support rails 11 increases from front to back. Also in FIG. 14 the pushing and pulling arms are pivotably mounted on movable frame 10 in an angled configuration such that each handle moves inward as it moves towards the front of the machine and each handle moves outward as it moves towards the rear portion of the machine.

Stationary base frame 5 can be constructed of any suitable material such as pipes or tubes and preferably is made of metal for strength and durability and is represented in the drawings herein as a metal tubing weldment or assembly with two parallel elongated tubes that are positioned below movable frame 10 and extend the substantial length of movable frame 10. A single tube is positioned on each end perpendicular to the two parallel tubes so as to join the two parallel tubes into a solid and sturdy base mostly rectangular shaped frame for supporting movable frame 10 and user U during operation of machine 1. However, stationary base frame 5 can be constructed in various configurations capable of supporting movable frame 10 and user U during operation of machine 1.

Angle adjusting support arm assembly 15 can be constructed of any suitable materials that can adequately support movable frame 10 and user U during operation of machine 1 and are presented in the drawings herein such that angle adjusting support arm 16 is constructed of an elongated tube that is fastened at a rearward end to a central portion of movable frame 10 and pivots about angle adjusting support arm pivot 19. A forward end of angle adjusting support arm 16 is connected to a central portion of angle adjusting support arm cross brace 17 in a perpendicular configuration to provide stability to angle adjusting arm 16.

Angle adjusting support arm wheels 18 are connected to each end of angle adjusting support arm cross brace to allow angle adjusting support arm assembly 15 to roll forwards or backwards on the floor as angle adjusting arm support assembly 15 raises and lowers movable frame 10 during operation of machine 1.

Referring now to FIGS. 1-14, various assemblies and components are common to the first and second embodiments of the invention and are described in detail herein. Angle adjusting device 7 can be constructed of various components but is represented as an elongated outer cylinder having a first end and a second end and an inner angle adjusting shaft 8 having a first end and a second end that is represented as a threaded rod that rotates on the second end of angle adjusting device 7 outer cylinder as it extends or contracts. Angle adjusting shaft 8 has a coupling on the second end that connects to movable frame 10 at angle adjusting device upper pivot 13. In the first embodiment as illustrated in FIGS. 1-9, the first end of angle adjusting device 7 outer cylinder connects to base frame 5 at angle adjusting device lower pivot 6 and, in the second embodiment as illustrated in FIGS. 10-13, the first end of angle adjusting device 7 is connected to angle adjusting support arm 16 at angle adjusting device lower pivot 6.

In the first and second embodiments, angle adjusting device 7 outer cylinder is operatively engaged with a center portion of angle adjusting shaft 8 and a first end of angle adjusting shaft 8 rotates inside of angle adjusting device 7 outer cylinder. Although not illustrated, angle adjusting device 7 is represented as being a known common actuating device that is powered by an electric motor to rotate threaded adjusting shaft 8 as it cooperates with a fixed threaded nut located at the second end of angle adjusting device 7 outer cylinder to cause threaded adjusting shaft 8 to extend or contract. However, alternatively, angle adjusting device 7 could operate with a hydraulic or pneumatic cylinder or similar device to extend and contract adjusting shaft 8. Also, not illustrated so as to more clearly illustrate the mechanical components of the invention, an electronic control panel commands and controls the motion of angle adjusting device 7 and therefore the angle of movable frame 10 relative to the floor in the first and second embodiments of the invention.

Lower body user support rails 11 can be constructed of any material capable of supporting lower body user support assemblies 20 but are represented as metal tubes that are curved in shape to match the natural motion pattern of a user's lower body during an exercise motion. The rearward ends of lower body user support rails 11 are rigidly connected to movable frame 10 and the forward ends of lower body user support rails 11 are rigidly connected to movable frame 10. The lower body user support rails 11 are mostly identical and can be mounted to movable frame 10 in a parallel configuration or angled configuration.

Traveling member assemblies 80 can comprise various configurations for rollably engaging lower body user support rails 11 and are capable of supporting and moving lower body user support assemblies 20 and user U during operation of machine 1. Traveling member assemblies 80 are represented as triangular shaped inner and outer metal plates 81 fastened to concave wheels with a fixed axle protruding from the outer plate wherein two spaced traveling member wheels 83 engage the upper side of lower body user support rails 11 and are fastened in between traveling member inner frame plates 81 and traveling member inner frame plates 82. A traveling member wheel 83 engages the underside of lower body user support rails 11 and is fastened in between traveling member inner frame plates 81 and traveling member outer frame plates 82 such that the three wheels form a triangular configuration to capture the lower body user support rails 11. The traveling member outer frame plates 82 are rigidly connected proximal to the center of traveling member outer frame plates 82 to a traveling member axle 84 such that traveling member axle 84 extends from one side only from traveling member outer frame plates 82 in a perpendicular configuration.

Lower body user support assemblies 20 can be constructed of various materials capable of supported user U's body weight and transferring the force exerted by user U's legs and providing adequate comfort to user U's lower legs and feet during operation of machine 1. Foot platforms 21 are mostly rectangular plates large enough to support substantially all of user U's feet with a small section near user U's toes angled upward to assist in keeping the user's feet securely positioned and to allow the user to impart maximum force during the pushing motion of the exercise. Shin pads 23 are mostly rectangular shaped boards or plates that are padded on the surface and configured to comfortably support user U's shins and ankles and support a substantial portion of user U's body weight and provide a cushioned exertion surface for user U's upper feet and ankles during the pulling motion of the exercise. Shin pads 23 are secured to an upper portion of lower body user support frames 22 and lower body user support frames 22 are formed metal components that are rigidly connected at a lower end to the first end of first lower body user support linkage bars 24 and lower body user support pivot 29. Lower body user support pivot 29 pivotally connects lower body user support assemblies 20 to traveling member assemblies 80 and pivots about traveling member axle 84 during operation of machine 1. First lower body user support linkage bars 24 have first ends and second ends and second lower body user support linkage bars 26 have first ends and second ends and the first ends of first lower body user support linkage bars 24 are rigidly connected to lower body user support pivots 29 and lower body user support frames 22 and pivotally connected at the second ends to the first ends of second lower body user support linkage bars 26. The second end of second lower body user support linkage bars 26 are rigidly connected to left linkages connection hub 70L and right linkages connection hub 70R.

Upper body user support assemblies 30 can be constructed of various materials capable of comfortably supporting user U's upper body and transferring the force of user U's arms during operation of machine 1. Upper body user support lever arms 31 have a first end and a second end and can be constructed of any rigid material but are represented as round metal cylinders that pivot at a first end about upper body user support pivots 34. Upper body user support pivots 34 can be mounted on movable frame 10 in a non-parallel configuration. Upper body user support adjusting shafts 32 have first ends and second ends and a central portion of upper body user support adjusting shafts 32 are operatively engaged with the second end of upper body user support lever arms 31 as the first ends of upper body user support adjusting shafts 32 rotate inside of upper body user support lever arms 31 when the length of upper body user support assemblies 30 are being adjusted. Second ends of upper body user support shafts 32 are rigidly connected to upper body user support grip handles 33 such that adjustment of the length of upper body user support assemblies 30 creates the correct motion for the exercise in cooperation with the angle of adjustment of movable frame 10.

Although some components are not illustrated, the angle adjusting device for upper body user support assemblies 30 is represented as being a known common actuating device that is powered by an electric motor to rotate threaded upper body user support adjusting shafts 32 as they cooperate with a fixed threaded nut located at the second end upper body user support lever arms 31 to cause threaded upper body user support adjusting shaft 32 to extend or contract. However, alternatively, upper body user support angle adjusting shafts 32 could operate with a hydraulic or pneumatic cylinder or similar device to extend and contract upper body user support adjusting shafts 32 and upper body user support grip handles 33. Upper body user supports 30 also comprise upper body user support linkage connection flanges 35 which have a first end and a second end and upper body user support linkage bars 37 which have a first end and a second end. A first end of upper body user support linkage bar flanges 35 is rigidly connected at a first end to a first end of upper body user support lever arms 31 and pivotally connected at a second end to a first end of upper body user support linkage bars 37 and a second end of upper body user support linkage bars 37 are pivotally connected to left linkages connection hub flange 71L and right linkages connection hub flange 71R at upper body user support linkage bar upper pivot 38. Although not illustrated so as to more clearly illustrate the mechanical components of the invention, an electronic control panel commands and controls the length of upper body user support assemblies 30 and synchronizes that length with the angle of adjustment of angle adjusting device 7 and the angle of movable frame 10 so as to optimize the motion of each exercise position for user U during operation of machine 1.

Rotational resistance mechanism 40 can be comprised of various components that create an adjustable resistance to the rotation of a flywheel, fan blades, paddle wheels or the like. However, resistance mechanism 40 is represented as a flywheel with an electronically controlled resistance component such as a set of magnets. Rotational resistance mechanism 40 is rigidly mounted on rotational resistance axle 41 and preferably to a central portion of rotational resistance axle 41. Rotational resistance axle 41 is rotatably mounted on rotational resistance axle connection flange 42 and rotational resistance axle connection flange 42 is rigidly connected to movable frame 10 and preferably proximal to a central portion of movable frame 10 such that rotational resistance mechanism 40 moves with movable frame 10 when it is adjusted to various angles of exercise position relative to the floor. Although not illustrated, the resistance setting of rotational resistance mechanism 40 is controlled and adjusted by an electronic control panel.

Resistance drive assembly 50 is comprised of multiple components for transferring the synchronized force of pushing and pulling motions imparted by user U upon lower body user support assemblies 20 and upper body user support assemblies 30 to rotate rotational resistance mechanism 40 during operation of machine 1. An upper resistance drive sprocket 51 is rigidly connected to left linkages connection hub 70L and an upper resistance drive sprocket 51 is rigidly connected to right linkages connection hub 70R and lower resistance drive sprockets 52 are mounted on one-way clutches 53 that are mounted on and rotate rotational resistance axle 41. Upper resistance drive sprockets 51 and lower resistance drive sprockets 52 are operatively connected with flexible drive members 54 such that the reciprocal partial rotations of upper resistance drive sprockets 51 cause lower resistance drive sprockets 52 to rotate one-way clutches 53 which causes one directional rotation of rotational resistance axle 41 and rotational resistance mechanism 40 during operation of machine 1.

Left linkages connection hub 70L and right linkages connection hub 70R rotate less than 360 degrees in both directions on fixed linkages connection hub axle 72. Left linkages connection hub flange 71L is rigidly connected to left linkages connection hub 70L and right linkages connection hub flange 71R is rigidly connected to right linkages connection hub 70R.

Rocker arm linkage assembly 60 can be constructed of various components capable of operably connecting and transferring the pushing and pulling force of lower body user support assemblies 20 and upper body user support assemblies 30 during operation of machine 1. Rocker arm linkage assembly 60 is represented as rigid rocker arm 61 having a left end and a right end and a center rocker arm pivot 62 such that rocker arm pivot 62 pivotally connects rocker arm 61 to a central portion of movable frame 10, and rocker arm linkage bars 65 having first ends and second ends such that the left end of rocker arm 61 is pivotally connected to a first end of a linkage bar 65, the second end of said linkage bar 65 is pivotally connected to left linkages connection hub flange 71L, the right end of rocker arm 61 is pivotally connected to a first end of a linkage bar 65, and the second end of said linkage bar 65 is pivotally connected to right linkages connection hub flange 71R.

FIGS. 1-14 represent various angle positions of movable frame 10 relative to the floor. Each of the angles position the user U to perform a different type of exercise as gravity forces user U to support his or her body with different muscle groups and increase or decrease the exertion required from different muscle groups to perform each of the exercises. To optimize the biomechanical motion of each exercise, an electronic control panels synchronizes and controls the length of the upper body user support assembly 30 with the angle of the movable frame 10 such that any time the movable frame 10 is adjusted in angle the length of upper body user support assembly 30 is concurrently adjusted.

Figure 2:
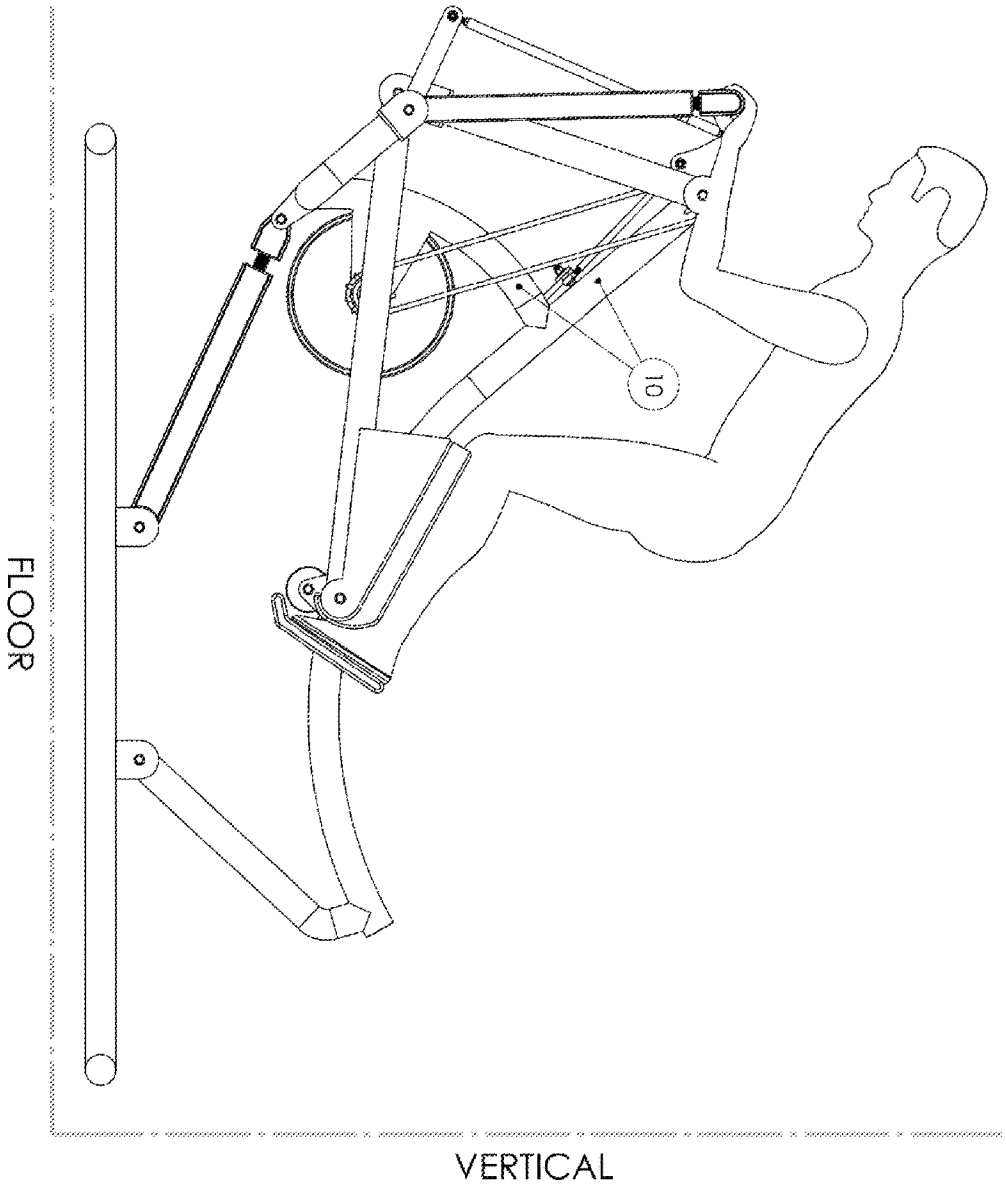
FIG. 2 is a side view of a first embodiment of the invention at a lower angle position with a user in a mid-point position of a simulated crawling motion exercise.
Figure 10:
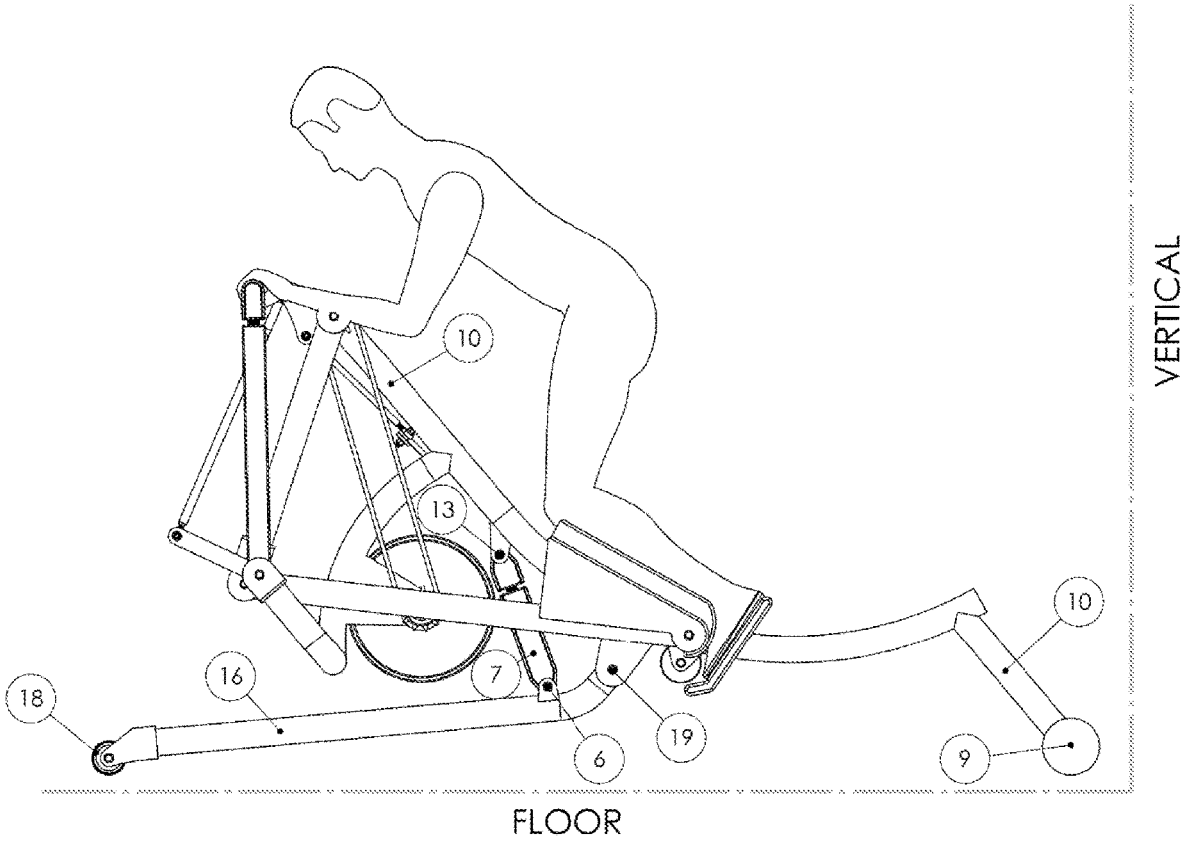
FIG. 10 is a side view of a second embodiment of the invention at a lower angle position with a user in a mid-point position of a simulated crawling motion exercise.

FIGS. 1, 2, and 10 represent a simulated crawling motion exercise wherein the user U is proximal to a maximum forward leaning position and user U's weight bearing is divided between the upper body user supports 30, and the angle of the movable user support and the length of the upper body user support assemblies are synchronized proximal to their lower settings to maximize the biomechanical motion of the exercise. In this exercise position, most of user U's lower body weight is supported by the left and right shin pads 23. In FIG. 1, user U is proximal to full pushing extension of user U's right arm and leg and proximal to full pulling contraction of user U's left arm and leg. In FIGS. 2 and 10, user U is at a mid-point in the exercise motion such that user U's left arm and left leg or right arm and right leg are at a mid-point of pushing and the other arm and leg are at a mid-point of pulling.

Figure 3:
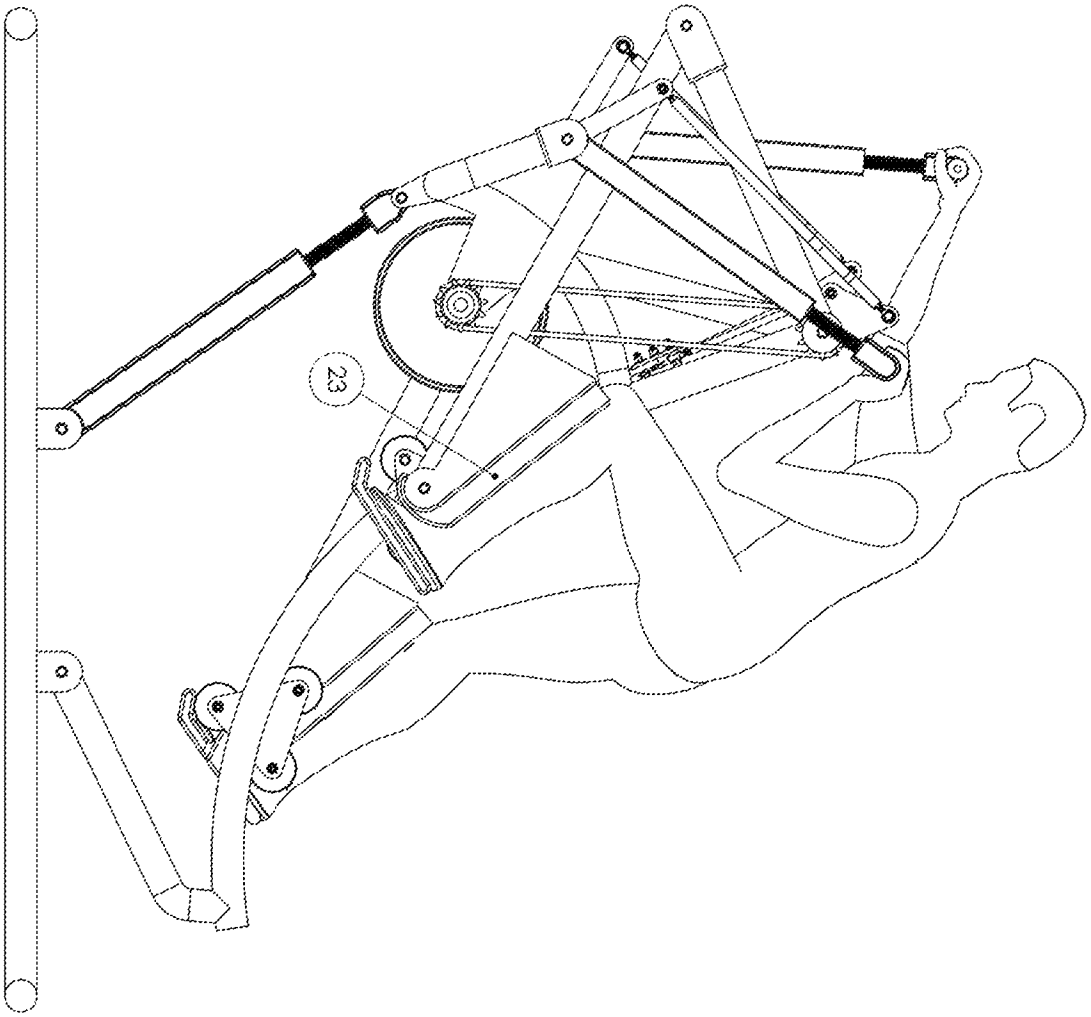
FIG. 3 is a side view of a first embodiment of the invention at a mid-point angle position with a user performing a simulated hill climbing exercise.
Figure 4:
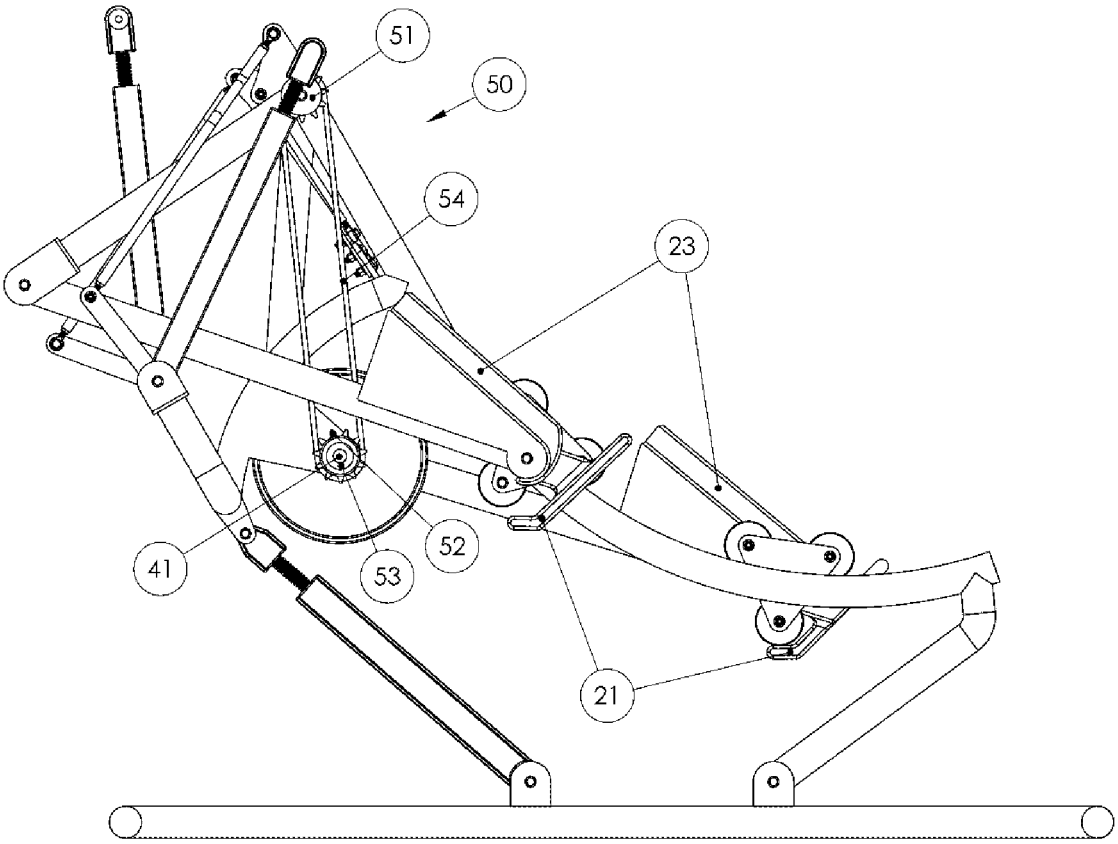
FIG. 4 is a side view of a first embodiment of the invention at a lower angle position.
Figure 5:
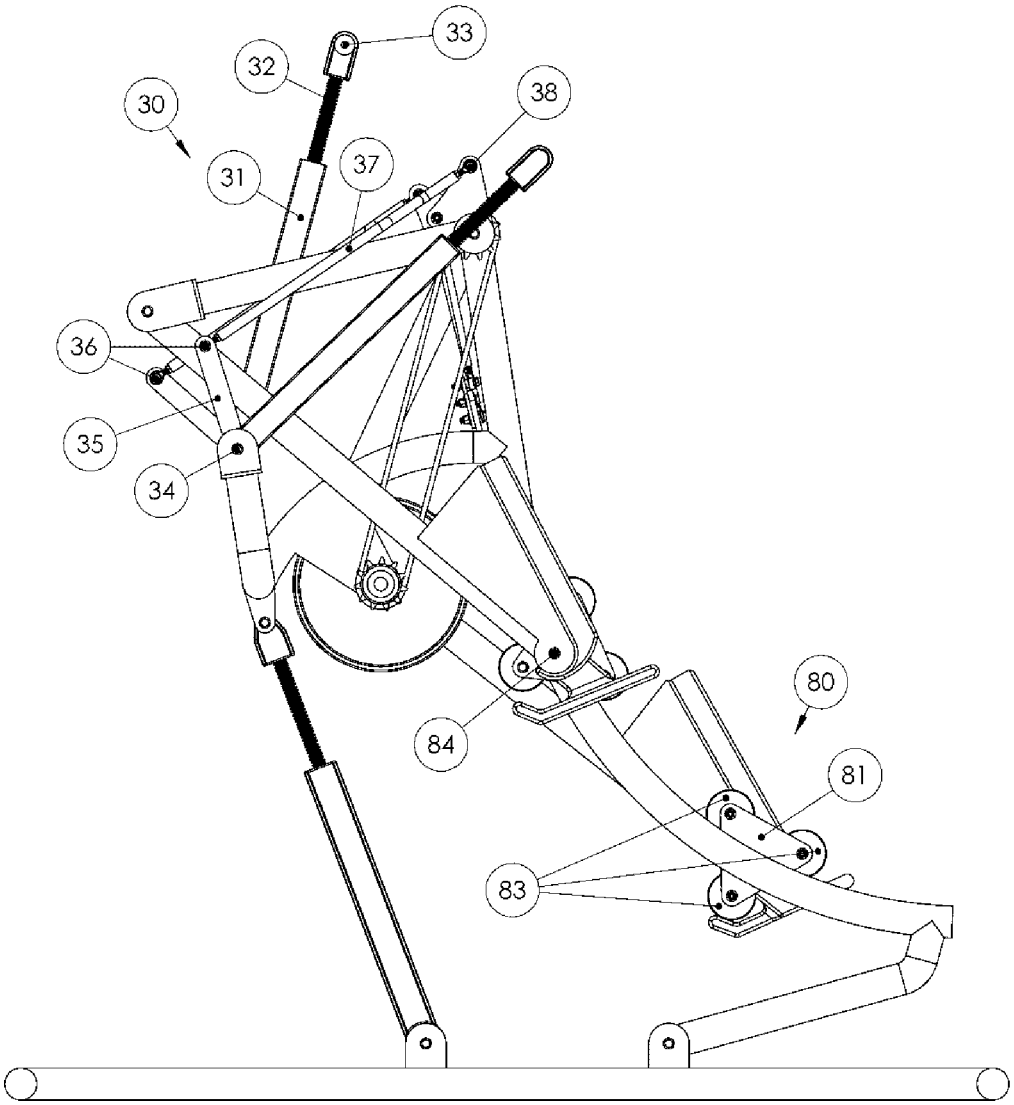
FIG. 5 is a side view of a first embodiment of the invention at a higher angle position.

FIGS. 3 and 13 represent a simulated hill climbing exercise wherein user U is in a mid-point forward leaning position and most of user U's weight bearing is supported by lower body user supports 20, and user U is capable of maximizing his or her leverage and pushing and pulling force by leaning into lower body user support shin pads 23 while gripping upper body user support grip handles 33. The angle of movable frame 10 and the length of upper body user supports 30 are synchronized at a mid-point location to optimize the biomechanical motion of the exercise.

Figure 6:
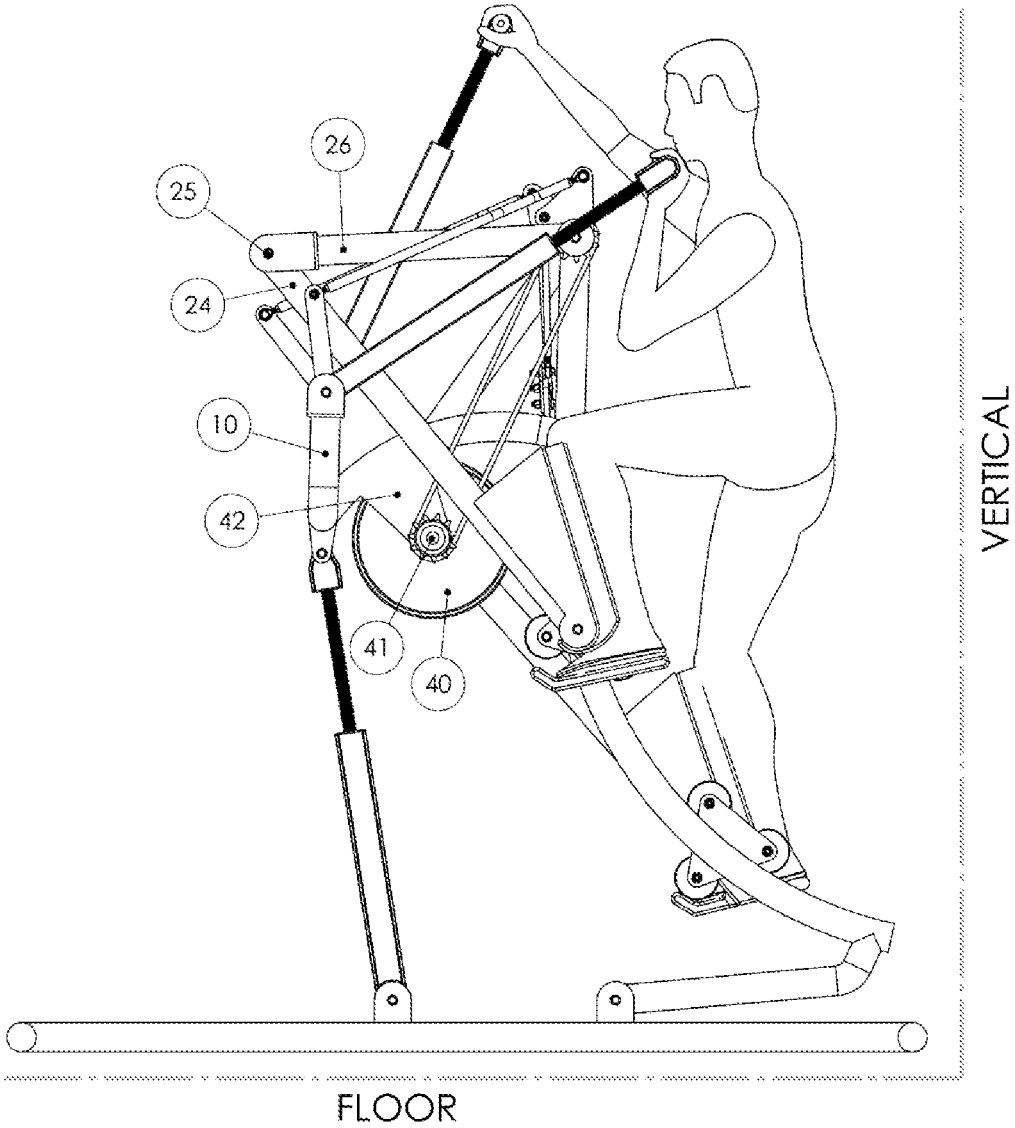
FIG. 6 is a side view of a first embodiment of the invention at a higher angle position with a user performing a simulated ladder climbing exercise.
Figure 7:
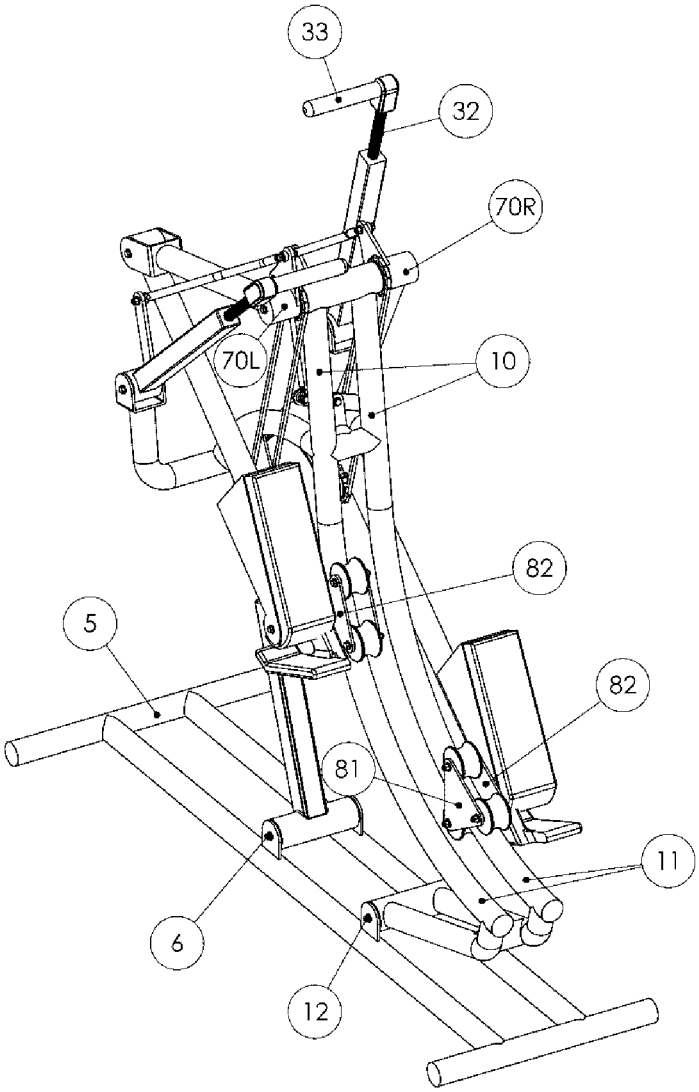
FIG. 7 is a rear perspective view of a first embodiment of the invention at a higher angle position.
Figure 8:
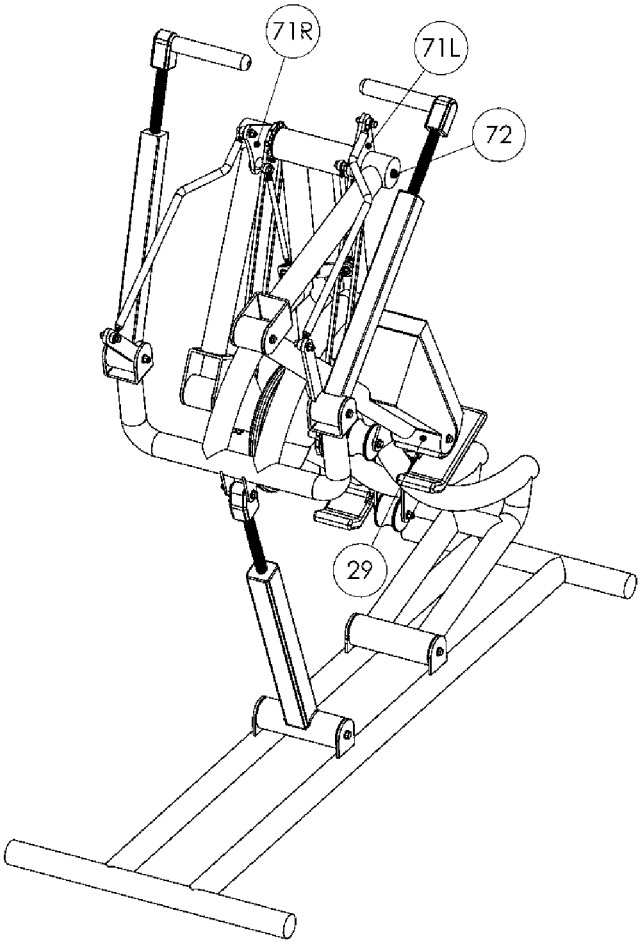
FIG. 8 is a front perspective view of a first embodiment of the invention at a higher angle position.
Figure 11:
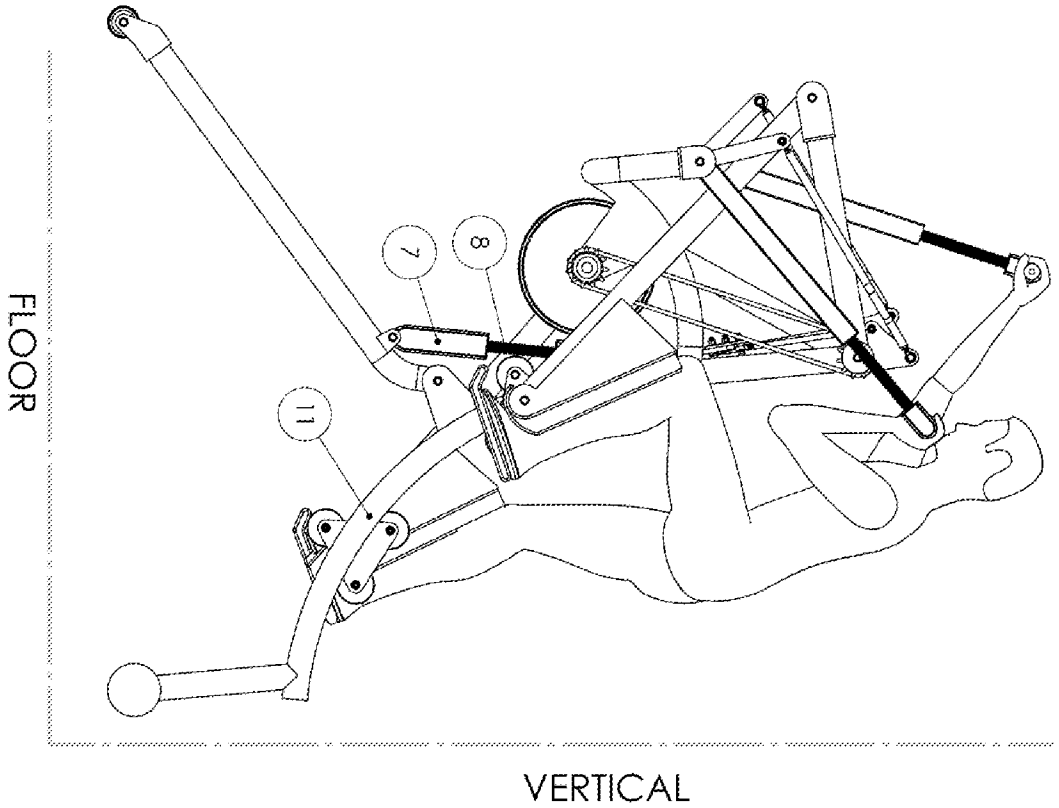
FIG. 11 is a side view of a second embodiment of the invention at a higher angle position with a user performing a simulated ladder climbing exercise.

FIGS. 6 and 11 represent a simulated ladder climbing exercise wherein user U is in a more vertical position and substantially all of user U's weight bearing is supported by lower user supports 20, and user U is capable of maximizing his or her leverage and pushing and pulling force by bracing against lower body user support shin pads 23 while gripping upper body user support grip handles 33. The angle of movable frame 10 is proximal to its highest setting and the length of upper body user supports 30 are synchronized proximal their longest length to optimize the biomechanical motion of the exercise.

Figure 12:
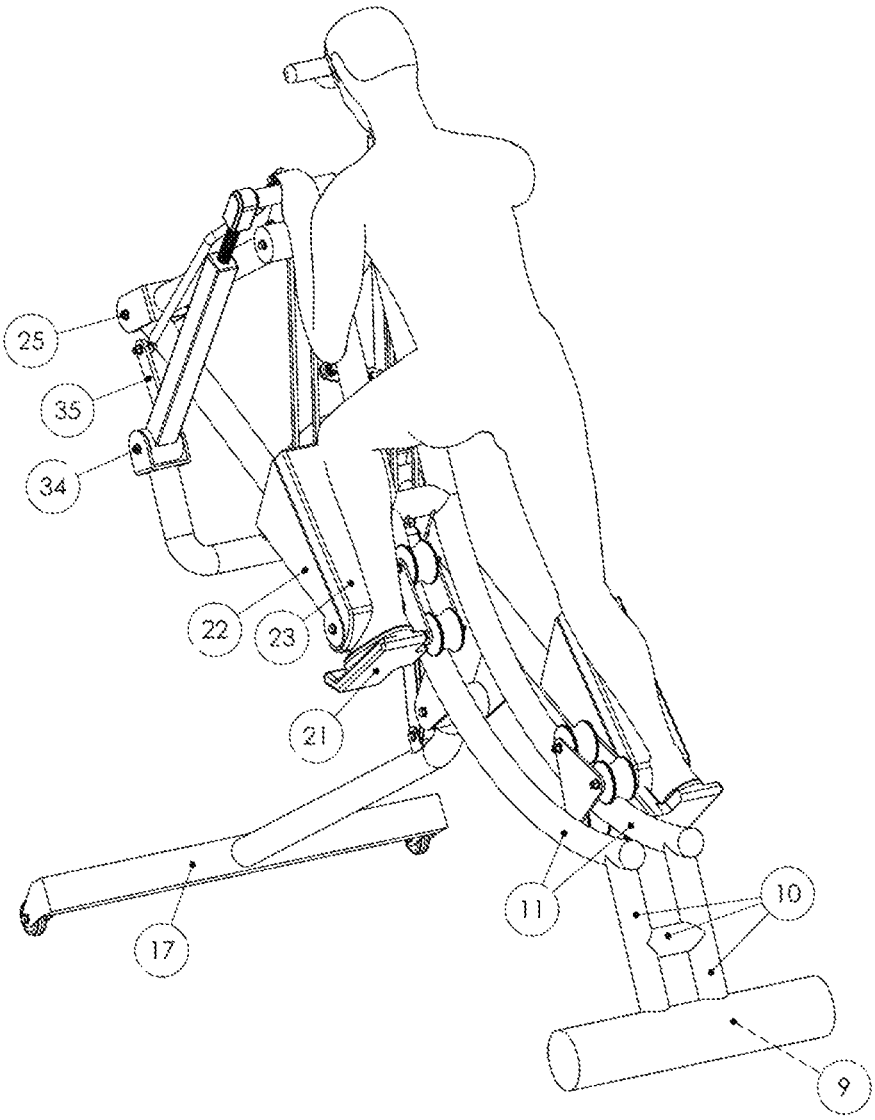
FIG. 12 is a rear perspective view of a second embodiment of the invention at a mid-point angle position with a user performing a simulated sprinting exercise.

FIG. 12 represents a simulated forward leaning sprinting motion wherein user U is in a mid-point forward leaning position and more of user U's weight bearing is supported by lower body user supports 20 than upper body user supports 30, and user U is leaning into and bracing against lower body user support shin pads 23 and leaning into and bracing against upper body user support grip handles 33 to obtain maximum leverage and exert maximum force into the user supports. The angle of movable frame 10 and the length of upper body user supports 30 are synchronized at a mid-point location to optimize the biomechanical motion of the exercise.

Figure 9:
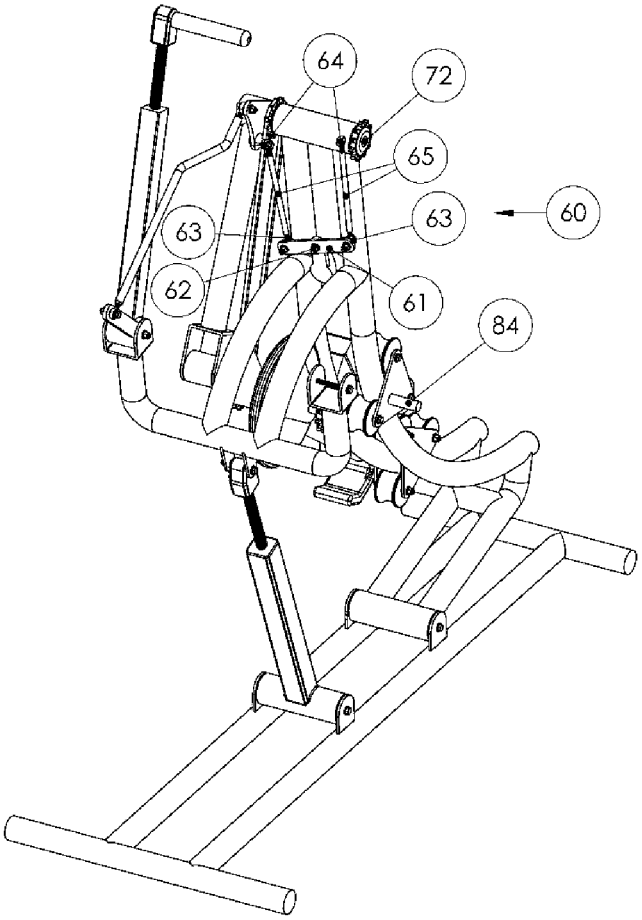
FIG. 9 is a front perspective view of a first embodiment of the invention at a higher angle position with a portion of the components removed so as to more clearly illustrate certain components of the machine.

FIG. 9 represents a partially disassembled embodiment of the invention wherein the left lower body user support assembly 20 and the left upper body user support assembly 30 have been removed to better illustrate some of the other features and components that are more central to the machine 1.

The optimal biomechanical motion and function of machine 1 is achieved when the length of upper body user support assemblies 30 is synchronized with the angle of movable frame 10 and the length of upper body user support assemblies 30 adjust in unison with the angle of movable frame 10. However, machine 1 can be operated such that the length of upper body user support assemblies 30 are not synchronized with the angle of movable frame 10 and the adjustment of upper body user support assemblies 30 are independent of the adjustment of the angle of movable frame 10.

To operate the invention in any position, user U steps onto left and right foot platforms 21 and leans forward towards machine 1 such that user U's shins, a portion of user U's ankles, the tops of user U's feet, and, based on the size of user U, possibly a portion of user U's knees, contact and brace against left and right shin pads 23, and user U grasps left and right upper body user support grip handles 33. User U may also set the desired resistance (resistance force) of rotational resistance mechanism 40, the desired angle position of movable frame 10, and the desired length of upper body user support assembly 30 prior to operating machine 1 with an electronic control panel that is not illustrated. Said electronic control panel may also comprise preset computer programs that can be selected by user U such that said electronic control panel can set and adjust the resistance of rotational resistance mechanism 40, the angle position of movable frame 10, and the length upper body user supports 30 prior to and during operation of machine 1 by user U.

To begin exercising on machine 1, user U will push against grip handle 33 and foot platform 21 with one side of user U's body while simultaneously pulling against the opposing grip handle 33 and shin pad 23 with the other side of user U's body. For example, if user U's right hand is gripping right grip handle 33 while user U's right arm is extending, then user U's right foot will be pressing against right foot platform 21 and user U's right lower leg will be bracing against right shin pad 23 while user U's right leg is extending, and user U's left hand will be gripping left grip handle 33 while user U's left arm is contracting and user U's left foot will be contacting left foot platform 21 and the top of user U's left foot, ankle and shin will be pulling against left shin pad 23 while user U's left leg is contracting. This exercise motion will cause right upper body user support lever arm 31 to pivot forward about right upper body user support pivot 34, causing right upper body user support linkage connection flange 35 to pivot forward about right upper body user support pivot 34, causing right upper body user support linkage bar 37 to move downward and pivot about right upper body user support linkage bar lower pivot 36 and right upper body user support linkage bar upper pivot 38, causing right linkages connection hub flange 71R to pivot forward about linkages connection hub axle 72.

Concurrently with this motion, right traveling member wheels 83 roll rearward on right lower body support rail 11 moving right lower body user support foot platform 21 and right shin pad 23 rearward on right lower body support rail 11 while right lower body user support frame 23 pivots about right travel member axle 84 at right lower body user support pivot 29, causing right first lower body user support linkage bar 24 to move rearward and pivot about right lower body user support linkage pivot 25, causing right second lower body user support linkage bar 26 to move rearward and pivot on right linkages connection hub 70R about linkages connection hub axle 72. This right side motion of machine 1 concurrently causes right upper resistance drive sprocket 51 to rotate forward, causing the forward portion of right flexible drive member 54 to move downward and rotate right lower resistance drive sprocket 52 forward, causing one-way clutch 53 to engage and rotate rotational resistance axle 41 and rotational resistance mechanism 40. This right side motion of machine 1 concurrently engages rocker arm linkage assembly 60 causing right side rocker arm linkage bar 65 to move downward and pivot on right rocker arm linkage upper pivot 64 and right rocker arm linkage lower pivot 64, causing rocker arm 61 to pivot about rocker arm pivot 62 and the right end of rocker arm 61 to move downward, causing the left end of rocker arm 61 to move upward, causing left rocker arm linkage bar 65 to move upward and pivot about left rocker arm linkage lower pivot 63 and left rocker arm linkage upper pivot.

This movement of rocker arm linkage assembly 60 concurrently causes left upper body user support lever arm 31 to pivot rearward about left upper body user support pivot 34, causing left upper body user support linkage connection flange 35 to pivot rearward about left upper body user support pivot 34, causing left upper body user support linkage bar 37 to move upward and pivot about left upper body user support linkage bar lower pivot 36 and left upper body user support linkage bar upper pivot 38, causing left linkages connection hub flange 71L to pivot rearward about linkages connection hub axle 72.

Concurrently with this motion, left traveling member wheels 83 roll forward on left lower body support rail 11 moving left lower body user support foot platform 21 and left shin pad 23 forward on left lower body support rail 11 while left lower body user support frame 23 pivots about left travel member axle 84 at left lower body user support pivot 29, causing left first lower body user support linkage bar 24 to move forward and pivot about left lower body user support linkage pivot 25, causing left second lower body user support linkage bar 26 to move forward and pivot on left linkages connection hub 70R about linkages connection hub axle 72.

This left side motion of machine 1 concurrently causes left upper resistance drive sprocket 51 to rotate rearward, causing the forward portion of left flexible drive member 54 to move upward and rotate left lower resistance drive sprocket 52 rearward, causing one-way clutch 53 to disengage from rotational resistance axle 41. The reciprocal and opposite motion of operating the left and right sides of machine 1 reverses the order of the concurrent motion of the components of machine 1.

User U can perform multiple reciprocal repetitions of pushing and pulling motions at a fixed angle or at various angles during an exercise session.

Rocker arm linkage assembly 60 cooperatively links left side upper and lower body user supports to the right side upper and lower body user supports of machine 1 such that user U can combine synchronized pushing and pulling motions with all four limbs to rotate rotational resistance axle 41 and propel rotational resistance mechanism 40.

In various embodiments, the lower body support rails 11 that are mounted on the movable user support frame 10 can have a curved shape. Alternatively, in various other embodiments, the lower body support rails 11 that are mounted on the movable user support frame 10 can have a straight or linear shape.

While the invention has been described in connection with certain preferred embodiments, it is not intended to limit the spirit or scope of the invention to the particular forms set forth, but is intended to cover such alternatives, modifications, and equivalents as may be included within the true spirit and scope of the invention as defined by the appended claims.

REFERENCE NUMERALS

U User
1 Machine
5 Stationary base frame
6 Angle adjusting device lower pivot
7 Angle adjusting device
8 Angle adjusting shaft
9 Movable frame foot
10 Movable frame
11 Lower body support rail
12 Movable frame base pivot
13 Angle adjusting device upper pivot
15 Angle adjusting support arm assembly
16 Angle adjusting support arm
17 Angle adjusting support arm cross brace
18 Angle adjusting support arm wheels
19 Angle adjusting support arm pivot
20 Lower body user support assembly
21 Foot platform
22 Lower body user support frame
23 Shin pad
24 First Lower body user support linkage bar
25 Lower body user support linkage pivot
26 Second lower body user support linkage bar
29 Lower body user support frame pivot
30 Upper body user support assembly
31 Upper body user support lever arm
32 Upper body user support adjusting shaft
33 Upper body user support grip handle
34 Upper body user support pivot
35 Upper body user support linkage connection flange
36 Upper body user support linkage bar lower pivot
37 Upper body user support linkage bar
38 Upper body user support linkage bar upper pivot
40 Rotational resistance mechanism
41 Rotational resistance axle
42 Rotational resistance axle connection flange
50 Resistance drive assembly
51 Upper resistance drive sprocket
52 Lower resistance drive sprocket
53 One-way clutch
54 Flexible drive member
60 Rocker arm linkage assembly
61 Rocker arm
62 Rocker arm pivot
63 Rocker arm linkage lower pivot
64 Rocker arm linkage upper pivot
65 Rocker arm linkage bar
70L Left linkages connection hub
70R Right linkages connection hub
71L Left linkages connection hub flange
71R Right linkages connection hub flange
72 Linkages connection hub axle
80 Traveling member assembly
81 Traveling member inner frame plate
82 Traveling member outer frame plate
83 Traveling member wheels
84 Traveling member axle

What is claimed is:

1. An upper and lower body push and pull exercise machine with a one directional resistance mechanism and adjustable angle comprising:

a) a stationary horizontal base frame having a forward end and a rearward end;

b) an angle adjusting device mounted on the stationary base frame;

c) a movable user support frame having a forward end and a rearward end, the rearward end of the movable user support frame being pivotally connected proximal to the rearward end of the base frame, and a forward or central portion of the movable user support frame being pivotally connected to the angle adjusting device;

d) at least one left side lower body support rail rigidly mounted on a rearward and central portion of the movable user support frame and at least one right side lower body support rail rigidly mounted on a rearward and central portion of the movable user support frame;

e) a left side traveling member rollably or slidably engaged with the at least one left side lower body support rail and a right side traveling member rollably or slidably engaged with the at least one right side lower body support rail;

f) a left side lower body user support comprising a foot support platform and shin support pad and a right side lower body user support comprising a foot support platform and shin support pad, the left side lower body user support being pivotally connected to the left side traveling member and the right side lower body user support being pivotally connected to the right side traveling member;

g) a left side upper body user support mounted on a forward portion of the movable user support frame, said left side upper body user support comprising a lever arm having a first end and a second end, the first end being pivotally connected to a forward portion of the movable user support frame and the second end being configured as a hand gripping surface, and a right side upper body user support mounted on a forward portion of the movable user support frame, said right side upper body user support comprising a lever arm having a first end and a second end, the first end being pivotally connected to a forward portion of the movable user support frame and the second end being configured as a hand gripping surface;

h) a left side linkages connection hub pivotally mounted proximal to a forward portion of the movable user support frame, and a right side linkages connection hub pivotally mounted proximal to a forward portion of the movable user support frame;

i) a left side lower body user support linkage assembly operatively connecting the left side lower body user support to the left side linkages connection hub, and a right side lower body user support linkage assembly operatively connecting the right side lower body user support to the right side linkages connection hub;

j) a left side upper body user support linkage assembly operatively connecting the left side upper body user support to the left side linkages connection hub, and a right side upper body user support linkage assembly operatively connecting the right side upper body user support to the right side linkages connection hub;

k) a rocker arm linkage assembly pivotally connected to a central portion of the movable user support frame and operatively connecting the left side upper and lower body user supports to the right side upper and lower body user supports such that all four user supports move in unison;

l) a resistance axle rotatably mounted on a central portion of the movable user support frame and a rotational one direction resistance mechanism rigidly connected to the resistance axle, and;

m) a resistance drive assembly operatively connecting the left side linkages connection hub and the right side linkages connection hub to the resistance axle and the rotational one direction resistance mechanism.

2. The exercise machine of claim 1, wherein the angle of the movable user support frame is adjustable relative to the floor to any angle on one side of a vertical line and above a horizontal line such that the angle of adjustment is less than 90 degrees and configured for a user to always be oriented at some angle of a forward leaning position during operation of the machine.

3. The exercise machine of claim 2, wherein the angle of the movable user support frame is adjustable prior to or during operation of the machine.

4. The exercise machine of claim 3, wherein a back and forth pattern of motion of the upper body user supports and the lower body user supports are fixed patterns of movement that are controlled by the machine, and the range of movement of the pattern of motion of the upper body user supports and the lower body user supports is controllable by the motion of the user.

5. The exercise machine of claim 4, wherein the lower body user support shin pads support at least a portion of the user's weight in at least a portion of the multi-angle operating positions of the movable user support frame.

6. The exercise machine of claim 5, wherein the left side linkages connection hub moves back and forth less than 360 degrees and the right side linkages connection hub moves back and forth less than 360 degrees.

7. The exercise machine of claim 6, wherein the left side upper body user support and left side lower body user support always move in opposite directions relative to each other and in unison such that movement of one concurrently causes movement of the other, and the right side upper body user support and right side lower body user support always move in opposite directions relative to each other and in unison such that movement of one concurrently causes movement of the other.

8. The exercise machine of claim 7, wherein the left side user supports and the right side user supports are in geometrically opposing positions prior to and during operation of the machine.

9. The exercise machine of claim 8, wherein the left side upper body user support lever arm pivots on a separate axle from a left linkages connection hub axle and the right side upper body user support lever arm pivots on a separate axle from a right linkages connection hub axle.

10. The exercise machine of claim 9 wherein:

the left side lower body user support linkage assembly comprises a first linkage bar having a first end and a second end and a second linkage bar having a first end and a second end, wherein the first end of the first linkage bar is rigidly connected to the left side lower body user support frame, the second end of the first linkage bar is pivotally connected to the first end of the second linkage bar, and the second end of the second linkage bar is rigidly connected to the left side linkages connection hub; and the right side lower body user support linkage assembly comprises a first linkage bar having a first end and a second end and a second linkage bar having a first end and a second end, wherein the first end of the first linkage bar is rigidly connected to the right side lower body user support, the second end of the first linkage bar is pivotally connected to the first end of the second linkage bar, and the second end of the second linkage bar is rigidly connected to the right side linkages connection hub.

11. The exercise machine of claim 10, wherein:

the left side upper body user support linkage assembly comprises a linkage bar having a first end and a second end such that the first end of the linkage bar is pivotally connected proximal to the first end of the left side upper body user support lever arm and the second end of the linkage bar is pivotally connected proximal to the second end of the left second lower body user support linkage bar; and the right side upper body user support linkage assembly comprises a linkage bar having a first end and a second end such that the first end of the linkage bar is pivotally connected proximal to the first end of the right side upper body user support lever arm and the second end of the linkage bar is pivotally connected proximal to the second end of the right second lower body user support linkage bar.

12. The exercise machine of claim 11, wherein the rocker arm linkage assembly comprises a rocker arm having a left end and a right end, a left linkage bar having a first end and a second end, and a right linkage bar having a first end and a second end, and a center portion of the rocker arm is pivotally connected to the movable user support frame, the left end of the rocker arm is pivotally connected to the first end of the left linkage bar, the second end of the left linkage bar is pivotally connected proximal to the second end of the left second lower body user support linkage bar, the right end of the rocker arm is pivotally connected to the first end of the right linkage bar, and the second end of the right linkage bar is pivotally connected proximal to the second end of the right second lower body user support linkage bar.

13. The exercise machine of claim 12, wherein the rocker arm linkage assembly locates and controls the left and right upper and lower body user supports.

14. The exercise machine of claim 13, wherein the resistance drive assembly comprises:

at least two left side drive sprockets wherein a first left side drive sprocket is rigidly connected to the left side linkages connection hub, a second left side drive sprocket is connected to a left side of the resistance axle with a one-directional clutch, and the first and second of the at least two left side sprockets are operatively connected with an endless loop flexible member; and at least two right side drive sprockets wherein a first right side drive sprocket is rigidly connected to the right side linkages connection hub, a second right side drive sprocket is connected to a right side of the resistance axle with a one-directional clutch, and the first and second of the at least two right side sprockets are operatively connected with an endless loop flexible member.

15. The exercise machine of claim 14, wherein during operation of the machine the user can stop the motion of the user supports while the resistance axle and resistance mechanism continue to rotate such that movement of the user supports causes rotation of the resistance axle and resistance mechanism and rotation of the resistance axle and the resistance mechanism does not cause movement of the user supports.

16. The exercise machine of claim 15, wherein the left side upper body user support lever arm is adjustable in length and the right side upper body user support lever arm is adjustable in length.

17. The exercise machine of claim 16, wherein adjustment of angle of the movable user support frame, adjustment of the length of the left side upper body user support lever arm, and adjustment of the length of the right side upper body user support lever arm are synchronized and controlled by a control panel such that all three adjust in unison.

18. The exercise machine of claim 17, wherein the left and right side lower body support rails are more distal to each other at the rearward portion of the movable user support frame and more proximal to each other at the central portion of the movable user support frame such that the traveling members move in a diverging pattern from front to back.

19. The exercise machine of claim 17, wherein the left and right side upper body user support lever arms pivot in non-parallel planes of motion such that the upper body user support move in a converging pattern from back to front.

20. The exercise machine of claim 1, wherein the lower body support rails have a curved shape.

21. An upper and lower body push and pull exercise machine with a one directional resistance mechanism and adjustable angle:

a) a movable user support frame having a forward end and a rearward end and at least a portion of the movable user support frame is in movable contact with the floor;

b) an angle adjusting device and movable support arm operatively connected to a central or forward portion of the movable user support frame;

c) at least one left side lower body support rail rigidly mounted on a rearward and central portion of the movable user support frame and at least one right side lower body support rail rigidly mounted on a rearward and central portion of the movable user support frame;

d) a left side traveling member rollably or slidably engaged with the at least one left side lower body support rail and a right side traveling member rollably or slidably engaged with the at least one right side lower body support rail, and;

e) a left side lower body user support comprising a foot support platform and shin support pad and a right side lower body user support comprising a foot support platform and shin support pad, the left side lower body user support being pivotally connected to the left side traveling member and the right side lower body user support being pivotally connected to the right side traveling member;

f) a left side upper body user support mounted on a forward portion of the movable user support frame, said left side upper body user support comprising a lever arm having a first end and a second end, the first end being pivotally connected to a forward portion of the movable user support frame and the second end being configured as a hand gripping surface, and a right side upper body user support mounted on a forward portion of the movable user support frame, said right side upper body user support comprising a lever arm having a first end and a second end, the first end being pivotally connected to a forward portion of the movable user support frame and the second end being configured as a hand gripping surface;

g) a left side linkages connection hub pivotally mounted proximal to a forward portion of the movable user support frame, and a right side linkages connection hub pivotally mounted proximal to a forward portion of the movable user support frame;

h) a left side lower body user support linkage assembly operatively connecting the left side lower body user support to the left side linkages connection hub, and a right side lower body user support linkage assembly operatively connecting the right side lower body user support to the right side linkages connection hub;

i) a left side upper body user support linkage assembly operatively connecting the left side upper body user support to the left side linkages connection hub, and a right side upper body user support linkage assembly operatively connecting the right side upper body user support to the right side linkages connection hub;

j) a rocker arm linkage assembly pivotally connected to a central portion of the movable user support frame and operatively connecting the left side upper and lower body user supports to the right side upper and lower body user supports such that all four user supports move in unison;

k) a resistance axle rotatably mounted on a central portion of the movable user support frame and a rotational one direction resistance mechanism rigidly connected to the resistance axle, and;

l) a resistance drive assembly operatively connecting the left side linkages connection hub and the right side linkages connection hub to the resistance axle and the rotational one direction resistance mechanism.

22. The exercise machine of claim 21, wherein the angle adjusting device is operatively connected to the movable user support frame and operatively connected to the movable support arm and the movable support arm is operatively connected to the movable user support frame and operatively engaged with the floor.

23. The exercise machine of claim 22, wherein the angle of the movable user support frame is adjustable relative to the floor to any angle on one side of a vertical line and above a horizontal line such that the angle of adjustment is less than 90 degrees and configured for a user to always be oriented at some angle of a forward leaning position during operation of the machine.

24. The exercise machine of claim 23, wherein the angle of the movable user support frame is adjustable prior to or during operation of the machine.

25. The exercise machine of claim 24, wherein a back and forth pattern of motion of the upper body user supports and the lower body user supports are fixed patterns of movement that are controlled by the machine, and the range of movement of the pattern of motion of the upper body user supports and the lower body user supports is controllable by the motion of the user.

26. The exercise machine of claim 25, wherein the lower body user support shin pads support at least a portion of the user's weight in at least a portion of the multi-angle operating positions of the movable user support frame.

27. The exercise machine of claim 26, wherein the left side linkages connection hub moves back and forth less than 360 degrees the right side linkages connection hub moves back and forth less than 360 degrees.

28. The exercise machine of claim 27, wherein the left side upper body user support and left side lower body user support always move in opposite directions relative to each other and in unison such that movement of one concurrently causes movement of the other, and the right side upper body user support and right side lower body user support always move in opposite directions relative to each other and in unison such that movement of one concurrently causes movement of the other.

29. The exercise machine of claim 28, wherein the left side user supports and the right side user supports are in geometrically opposing positions prior to and during operation of the machine.

30. The exercise machine of claim 29, wherein the left side upper body user support lever arm pivots on a separate axle from a left linkages connection hub axle and the right side upper body user support lever arm pivots on a separate axle from a right linkages connection hub axle.

31. The exercise machine of claim 30 wherein:

the left side lower body user support linkage assembly comprises a first linkage bar having a first end and a second end and a second linkage bar having a first end and a second end, wherein the first end of the first linkage bar is rigidly connected to the left side lower body user support frame, the second end of the first linkage bar is pivotally connected to the first end of the second linkage bar, and the second end of the second linkage bar is rigidly connected to the left side linkages connection hub; and the right side lower body user support linkage assembly comprises a first linkage bar having a first end and a second end and a second linkage bar having a first end and a second end, wherein the first end of the first linkage bar is rigidly connected to the right side lower body user support, the second end of the first linkage bar is pivotally connected to the first end of the second linkage bar, and the second end of the second linkage bar is rigidly connected to the right side linkages connection hub.

32. The exercise machine of claim 31, wherein;

the left side upper body user support linkage assembly comprises a linkage bar having a first end and a second end such that the first end of the linkage bar is pivotally connected proximal to the first end of the left side upper body user support lever arm and the second end of the linkage bar is pivotally connected proximal to the second end of the left second lower body user support linkage bar; and the right side upper body user support linkage assembly comprises a linkage bar having a first end and a second end such that the first end of the linkage bar is pivotally connected proximal to the first end of the right side upper body user support lever arm and the second end of the linkage bar is pivotally connected proximal to the second end of the right second lower body user support linkage bar.

33. The exercise machine of claim 32, wherein the rocker arm linkage assembly comprises a rocker arm having a left end and a right end, a left linkage bar having a first end and a second end, and a right linkage bar having a first end and a second end, and a center portion of the rocker arm is pivotally connected to the movable user support frame, the left end of the rocker arm is pivotally connected to the first end of the left linkage bar, the second end of the left linkage bar is pivotally connected proximal to the second end of the left second lower body user support linkage bar, the right end of the rocker arm is pivotally connected to the first end of the right linkage bar, and the second end of the right linkage bar is pivotally connected proximal to the second end of the right second lower body user support linkage bar.

34. The exercise machine of claim 33, wherein the rocker arm linkage assembly locates and controls the left and right upper and lower body user supports.

35. The exercise machine of claim 34, wherein the resistance drive assembly comprises:

at least two left side drive sprockets wherein a first left side drive sprocket is rigidly connected to the left side linkages connection hub, a second left side drive sprocket is connected to a left side of the resistance axle with a one-directional clutch, and the first and second of the at least two left side sprockets are operatively connected with an endless loop flexible member; and at least two right side drive sprockets wherein a first right side drive sprocket is rigidly connected to the right side linkages connection hub, a second right side drive sprocket is connected to a right side of the resistance axle with a one-directional clutch, and the first and second of the at least two right side sprockets are operatively connected with an endless loop flexible member.

36. The exercise machine of claim 35, wherein during operation of the machine the user can stop the motion of the user supports while the resistance axle and resistance mechanism continue to rotate such that movement of the user supports causes rotation of the resistance axle and resistance mechanism and rotation of the resistance axle and the resistance mechanism does not cause movement of the user supports.

37. The exercise machine of claim 36, wherein the left side upper body user support lever arm is adjustable in length and the right side upper body user support lever arm is adjustable in length.

38. The exercise machine of claim 37, wherein the adjustment of angle of the movable user support frame, adjustment of the length of the left side upper body user support lever arm, and adjustment of the length of the right side upper body user support lever arm are synchronized and controlled by a control panel such that all three adjust in unison.

39. The exercise machine of claim 38, wherein the left and right side lower body support rails are more distal to each other at the rearward portion of the movable user support frame and more proximal to each other at the central portion of the movable user support frame such that the traveling members move in a diverging pattern from front to back.

40. The exercise machine of claim 38, wherein the left and right side upper body user support lever arms pivot in non-parallel planes of motion such that the upper body user support move in a converging pattern from back to front.

41. The exercise machine of claim 21, wherein the lower body support rails have a curved shape.

* * * * *